US007300200B2

(12) United States Patent
Suzuki

(10) Patent No.: US 7,300,200 B2
(45) Date of Patent: Nov. 27, 2007

(54) TIMEPIECE HAVING MAINSPRING WINDING STATE DISPLAY APPARATUS INCLUDING DEFORMED SEGMENT GEAR

(75) Inventor: Shigeo Suzuki, Chiba (JP)

(73) Assignee: Seiko Instruments Inc. (JP)

( * ) Notice: Subject to any disclaimer, the term of this patent is extended or adjusted under 35 U.S.C. 154(b) by 153 days.

(21) Appl. No.: 11/043,880

(22) Filed: Jan. 26, 2005

(65) Prior Publication Data

US 2005/0162982 A1 Jul. 28, 2005

(30) Foreign Application Priority Data

Jan. 27, 2004 (JP) ..... 2004-018501

(51) Int. Cl.
*G04B 9/00* (2006.01)

(52) U.S. Cl. ..... 368/212; 368/66

(58) Field of Classification Search ..... 368/66, 368/210, 212, 147, 148, 149, 150, 151, 152
See application file for complete search history.

(56) References Cited

U.S. PATENT DOCUMENTS

| | | | | |
|---|---|---|---|---|
| 744,456 | A * | 11/1903 | Aumen | 368/210 |
| 790,510 | A | 5/1905 | Mazer | |
| 790,512 | A | 5/1905 | Mazer | |
| 2,761,274 | A * | 9/1956 | Aurele Maire | 368/212 |
| 6,166,999 | A * | 12/2000 | Jujo et al. | 368/66 |
| 6,805,482 | B2 | 10/2004 | Berard | |
| 2001/0024405 | A1 | 9/2001 | Sebastien | |

FOREIGN PATENT DOCUMENTS

| | | | |
|---|---|---|---|
| CH | 68853 | A | 4/1915 |
| CH | 287934 | A | 12/1952 |
| CH | 301497 | A | 9/1954 |
| CH | 689414 | A3 | 4/1999 |
| EP | 0962839 | A1 | 12/1999 |
| JP | 09-021886 | | 1/1997 |
| JP | 09021886 | | 1/1997 |
| JP | 11183642 | | 7/1999 |

* cited by examiner

*Primary Examiner*—Ren Yan
(74) *Attorney, Agent, or Firm*—Adams & Wilks

(57) ABSTRACT

A timepiece has a mainspring winding state display apparatus for arranging a rotational center of a winding mark hand at an arbitrary pertinent position in a movement of the timeplace. The movement has a barrel complete and a speed reducing mechanism cooperatively moved with a barrel gear of the barrel complete for reducing a speed of ratotion of the barrel gear. A segment gear undergoes rotation in accordance with an output of the barrel gear. A winding mark indicator undergoes rotation in accordance with an operation of the segment gear. A mainspring winding state display member displays a winding state of the mainspring in accordance with rotation of the winding mark indicator. The segment gear includes a first segment gear for receiving an output of the speed reducing mechanism and a second segment gear for rotating the winding mark display wheel.

7 Claims, 19 Drawing Sheets

TIMEPIECE HAVING MAINSPRING WINDING STATE DISPLAY APPARATUS INCLUDING DEFORMED SEGMENT GEAR

BACKGROUND OF THE INVENTION

1. Field of the Invention

The present invention relates to a timepiece having a mainspring winding state display apparatus having a function of displaying a state of winding a mainspring constituting a power source of a mechanical time piece. Particularly, the invention relates to a timepiece having a mainspring winding state display apparatus constituted to be able to arrange a mainspring winding state display member (power reserve indicator) at an arbitrary pertinent position in a movement of the time piece.

2. Description of the Prior Art (1) A Time Piece Having a Mainspring Winding State Display Apparatus of a First Type of a Background Art.

A time piece having a mainspring winding state display apparatus of a first type of a background art includes a mechanism (power reserve mechanism) for displaying a remaining time period in which a mainspring can operate, that is, a duration of the timepiece. Such a power reserve mechanism uses a planetary gear mechanism for reciprocating a hand for displaying the duration of the timepiece in a fan-like shape. The timepiece having the mainspring winding state display apparatus of the first type of the background art is constituted by a ratchet wheel, a planetary gear mechanism constituted by a planetary intermediate gear brought in mesh with a barrel complete, a planetary wheel rotatably attached to an eccentric portion of the planetary intermediate gear, a sun gear brought in mesh with a planetary pinion, and a second sun wheel brought in mesh with a planetary gear, a display transmission wheel brought in mesh with a sun pinion, a display wheel brought in mesh with a display transmission pinion, a display degree determining pin, and a planetary transmission wheel brought in mesh with the ratchet wheel and a second sun gear (refer to, for example, JP-A-9-21886).

(2) A Timepiece Having a Mainspring Winding State Display Apparatus of a Second Type of a Background Art.

A timepiece having a mainspring winding state display apparatus of a second type of a background art is provided with a planetary intermediate gear provided to be able to rotate by rotation of a barrel complete gear, a planetary wheel rotatably provided to the planetary intermediate gear by constituting a rotational center at a portion different from a rotational center of the planetary intermediate gear and having a first planetary wheel and a second planetary wheel rotatable integrally, a first sun wheel rotatably provided by constituting a rotational center by the rotational center of the planetary intermediate gear and having a first sun gear brought in mesh with a second planetary wheel, a second sun wheel provided rotatably by constituting a rotational center by the rotational center of the first sun wheel and having a second sun gear brought in mesh with a ratchet transmission wheel and a second sun pinion brought in mesh with the first planetary wheel, a claw wheel attached to the first sun wheel and having one or more feed claws, a winding mark intermediate wheel provided rotatably intermittently by the feed claw, a winding mark jumper for rectifying a position in a rotational direction of the winding mark intermediate wheel, and a mainspring winding state display member (power reserve indicator) for displaying a mainspring winding state based on rotation of the winding mark intermediate wheel (refer to, for example, JP-A-11-183642).

According to the timepiece having the mainspring winding state display apparatus of the background art, a rotational center of the mainspring winding state display member (that is, winding mark hand: power reserve indicator) is arranged at a vicinity of a rotational center of the barrel complete gear. Therefore, in the timepiece having the mainspring winding state display apparatus, with regard to arrangement of a plurality of indicators (hour hand, minute hand, second hand, winding mark hand or the like), there is a restriction in view of design. Further, in the timepiece having the mainspring winding state display apparatus of the background art, when the rotational center of the mainspring winding state display member is arranged at a position remote from the rotational center of the barrel complete gear, rotation needs to transmit from the barrel complete gear to the mainspring winding state display member via a wheel train. According to such a structure, backlashes of mesh are present among the plurality of gears, and there poses a problem that operation of the winding mark hand (power reserve indicator) is retarded.

It is an object of the invention to provide a timepiece having a mainspring winding state display apparatus such that a rotational center of a winding mark hand (power reserve indicator) can be arranged at an arbitrary pertinent position in a movement of the timepiece regardless of a position of a rotational center of a barrel complete gear.

It is another object of the invention to prevent the operation of a winding mark hand (power reserve indicator) from being retarded by reducing influence of backlashes of mesh among gears for transmitting rotation to the winding mark hand (power reserve indicator) in a timepiece having a mainspring winding state display apparatus.

It is still another object of the invention to provide a small and thin timepiece having a mainspring winding state display apparatus in which a restriction in view of design is very inconsiderable.

SUMMARY OF THE INVENTION

According to the invention, in a timepiece having a mainspring winding state display apparatus having a function of displaying a state of winding a mainspring constituting a power source of a mechanical timepiece, the timepiece includes a barrel complete including a mainspring and a barrel gear and constituted to be able to be rotated only in one direction by winding back the mainspring by the barrel gear, a speed reducing mechanism for reducing a speed of rotation of the barrel gear, a segment gear capable of being rotated based on an output of the speed reducing mechanism, a winding mark display wheel capable of being rotated based on an operation of the segment gear, and a mainspring winding state display member for displaying a state of winding the mainspring based on rotation of the winding mark display wheel. By the constitution, a rotational center of the main spring winding state display member (that is, a rotational center of the winding mark hand) can be arranged at an arbitrary pertinent position in a movement of the timepiece regardless of a position of a rotational center of the barrel gear. Further, by the constitution, an influence of backlashes of mesh among gears for transmitting rotation to the winding mark hand can be reduced and operation of the winding mark hand can be prevented from being retarded.

It is preferable to constitute the timepiece having a mainspring winding state display apparatus of the invention such that the speed reducing mechanism is constituted by a planetary unit, the planetary unit includes a first sun wheel fixed to a barrel stem, a planetary wheel rotatably attached to a bottom face of the barrel gear and a second sun wheel rotatably attached to the barrel stem, and the planetary wheel is made to be able to be rotated while revolving around the first sun wheel when the barrel gear is rotated.

Further, according to the timepiece having a mainspring winding state display apparatus of the invention, it is preferable that the segment gear includes a first segment gear for receiving the output of the speed reducing mechanism and a second segment gear for rotating the winding mark display wheel.

Further, the timepiece having a mainspring winding state display apparatus of the invention includes a main plate, a hand setting stem, and an hour wheel. Further, a main plate reference vertical axis line passing a rotational center of the hour wheel and substantially in parallel with a center axis line of the hand setting stem and a main plate reference horizontal axis line passing the rotational center of the hour wheel and orthogonal to the main plate reference vertical axis line are defined at the main plate and a first region disposed on one side of the main plate reference vertical axis line and disposed on a side of the main plate reference horizontal reference vertical axis line proximate to the hand setting stem, a second region disposed on other side of the main plate reference vertical axis line and disposed on a side of the horizontal axis line proximate to the hand setting stem, a third region disposed on the other side of the main plate reference vertical axis line where the second region is present and disposed on a side of the main plate reference horizontal axis line remote from the hand setting stem and a fourth region disposed on the one side of the main plate reference vertical axis line where the first region is present and disposed on the side of the main plate reference horizontal axis line remote from the hand setting stem are defined at the main plate. At this occasion, it is preferable that a rotational center of the barrel complete is arranged at the second region, a rotational center of the speed reducing mechanism is arranged at the same position as the rotational center of the barrel complete and a rotational center of the winding mark display wheel is arranged at a region on the main plate reference vertical axis line and in a 3 o'clock direction of a dial.

Further, a timepiece having a mainspring winding state display apparatus of the invention is constituted to include a barrel complete, a speed reducing mechanism moved cooperatively with the barrel gear for reducing a speed of rotation of the barrel gear, a segment gear capable of being rotated based on an output of the speed reducing mechanism, a winding mark display wheel capable of being rotated based on operation of the segment gear, a mainspring winding state display member for displaying a state of winding the mainspring based on rotation of the winding mark display wheel, and a plurality of winding mark display wheel supporting portions for rotatably supporting the winding mark display wheel, wherein the winding mark display wheel is supported by one portion of the plurality of winding mark display wheel supporting portions, and the segment gear is constituted to transmit operation of the speed reducing mechanism to the winding mark display wheel supported by one portion of the plurality of winding mark display wheel supporting portions. By the constitution, in the timepiece having the mainspring winding state display apparatus, regardless of a position of a rotational center of the barrel gear, a rotational center of a winding mark hand can be arranged at an arbitrary pertinent position in a movement of the timepiece. Further, since the plurality of winding mark display wheel supporting portions are provided in the movement, it is not necessary to prepare a plurality of movements for changing the position of the rotational center of the winding mark hand. Further, by the constitution, a small and thin timepiece having a mainspring winding state display apparatus can be realized.

Further, it is preferable to constitute the timepiece having a mainspring winding state display apparatus of the invention such that the segment gear includes a first segment gear for receiving the output of the speed reducing mechanism and the first segment gear is made to rotate the winding mark display wheel. Further, it is preferable to constitute the timepiece having a mainspring winding state display apparatus of the invention such that the segment gear includes the first segment gear for receiving the output of the speed reducing mechanism and other segment gear, and the other segment gear is constituted to rotate the winding mark display wheel. By the constitution, in the timepiece having the mainspring winding state display apparatus, an influence of backlashes of mesh among gears for transmitting rotation to the winding mark hand can be reduced and operation of the winding mark hand can be prevented from being retarded.

Further, the invention is constituted such that a timepiece having a mainspring display apparatus includes a barrel complete, a speed reducing mechanism moved cooperatively with the barrel gear for reducing a speed of rotation of the barrel gear, a winding mark display wheel rotated based on operation of the speed reducing mechanism, and a mainspring winding state display member for displaying a state of winding a mainspring based on rotation of the winding mark display wheel. The timepiece having the mainspring winding state display apparatus is characterized in that the speed reducing mechanism is constituted by a planetary unit, the planetary unit includes a first sun wheel fixed to a barrel stem, a planetary wheel rotatably attached to a bottom face of a barrel gear, and a second sun wheel rotatably attached to the barrel stem, the planetary wheel is constituted to be able to be rotated while revolving around the first sun wheel when the barrel gear is rotated, and is constituted to rotate the winding mark display wheel based on rotation of the second sun wheel. By the constitution, in the timepiece having the mainspring winding state display apparatus, regardless of a position of a rotational center of the barrel gear, a rotational center of the winding mark hand can be arranged at an arbitrary pertinent position in a movement of the timepiece. Further, a plurality of winding mark display wheel supporting portions are provided in the movement and therefore, it is not necessary to prepare a plurality of movements for changing the position of the rotational center of the winding mark hand.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
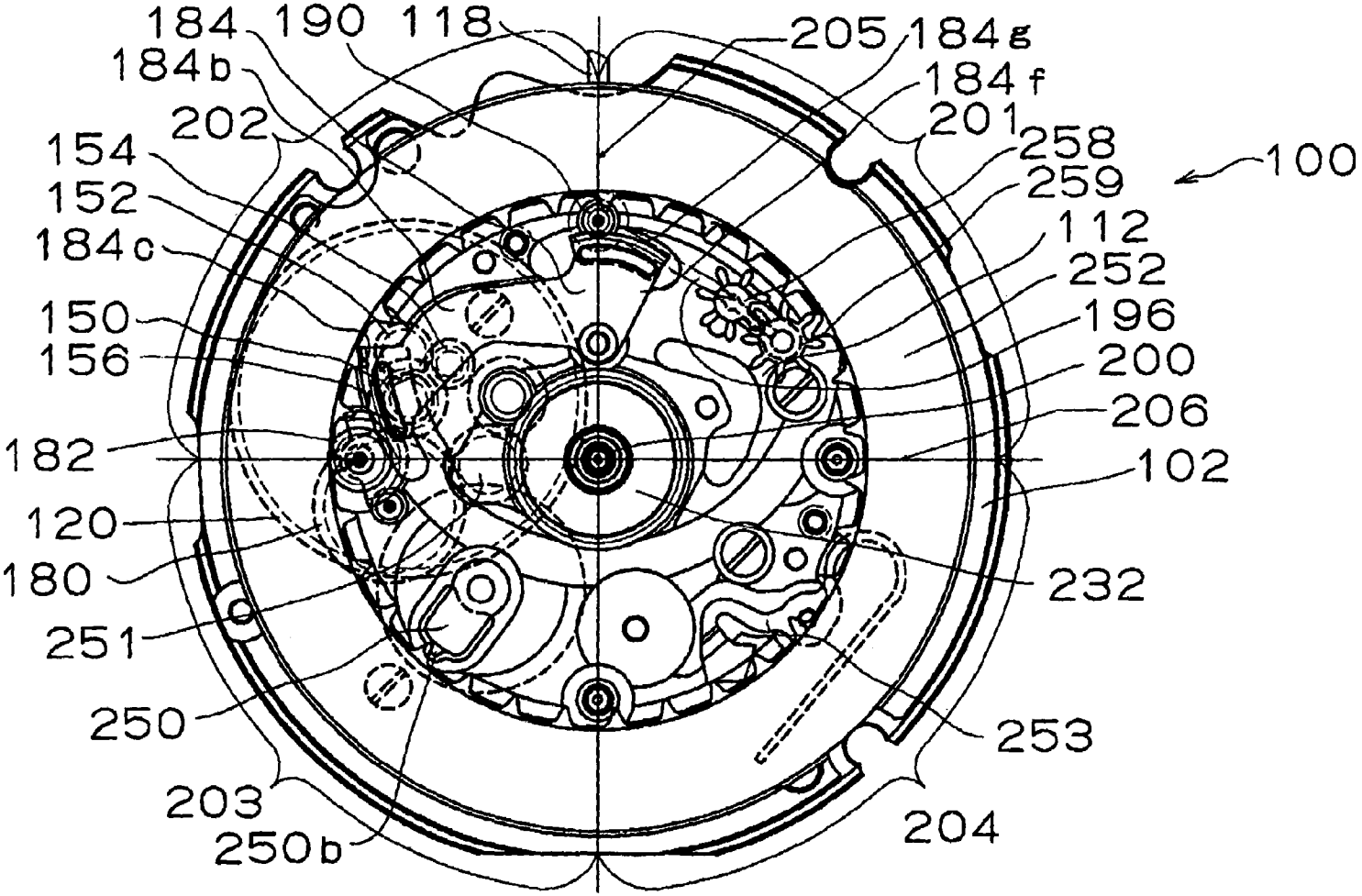
FIG. 1 is a plane view (back plane view) showing a state of viewing a movement in a state of releasing a mainspring from a side of a dial according to a first embodiment of a timepiece having a mainspring winding state display apparatus of the invention.

An embodiment of a timepiece having a mainspring winding state display apparatus according to the invention will be explained in reference to the drawings as follows.

(1) First Embodiment

(1•1) Total Constitution of Movement

First, an explanation will be given of a first embodiment of a timepiece having a mainspring winding state display apparatus according to the invention. In reference to FIG. 1 through FIG. 4, a timepiece having a mainspring winding state display apparatus of the invention is provided with a movement 100. "Movement" indicates a machine body of the timepiece including a drive portion. Further, "complete" indicates a finished body of a timepiece in which a dial, indicators (hour hand, minute hand, second hand and the like), a crown and the like are attached to the movement of the timepiece to be contained in a time case (timepiece exterior). The movement 100 includes a main plate 102, a second main plate 112, and a date indicator maintaining plate 116. In the movement 100, "top side" indicates a side of two faces of the main plate 102 remote from glass of the timepiece case, that is, "case back side". In the movement 100, "back side" indicates a side of the two faces of the main plate 102 proximate to the glass of the timepiece case, that is, "dial side". The movement 100 further includes a first bridge 104, a second bridge 105, a pallet fork bridge 106, and a balance bridge 107. The second main plate 112, and the date indicator maintaining plate 116 are arranged on the back side of the main plate 102. A dial 110 is arranged on the side of the glass of the second main plate 112. The dial 110 is attached to the main plate 102 via a dial support ring 109. A hand setting stem 118 is integrated to the main plate 102 rotatably and movably in an axis line direction.

A top side of the movement 100 is arranged with a top train wheel, an escaping mechanism, a speed control mechanism, an automatic winding mechanism, a hand winding mechanism, a switching apparatus, and a planetary mechanism for operating a mainspring winding state display mechanism. Alternatively, the hand winding mechanism may be deleted. Alternatively, the switching apparatus may be arranged on the back side of the movement 100. Alternatively, the hand winding mechanism may be arranged on the top side of the movement 100 and the automatic winding mechanism may be omitted. The back side of the movement 100 is arranged with a back train wheel, a date indicating mechanism, a date correcting mechanism, and a mainspring winding state display mechanism operated by a planetary mechanism. The top train wheel is roatatably supported by the main plate 102, the first bridge 104, and the second bridge 105. The back train wheel is rotatably supported by the main plate 102, the second main plate 112, and the date indicator maintaining plate 116. Alternatively, the date indicating mechanism and the date correcting mechanism may be omitted. When needed, a day indicating mechanism and a day correcting mechanism may be provided on the back side of the movement 100.

Figure 2:
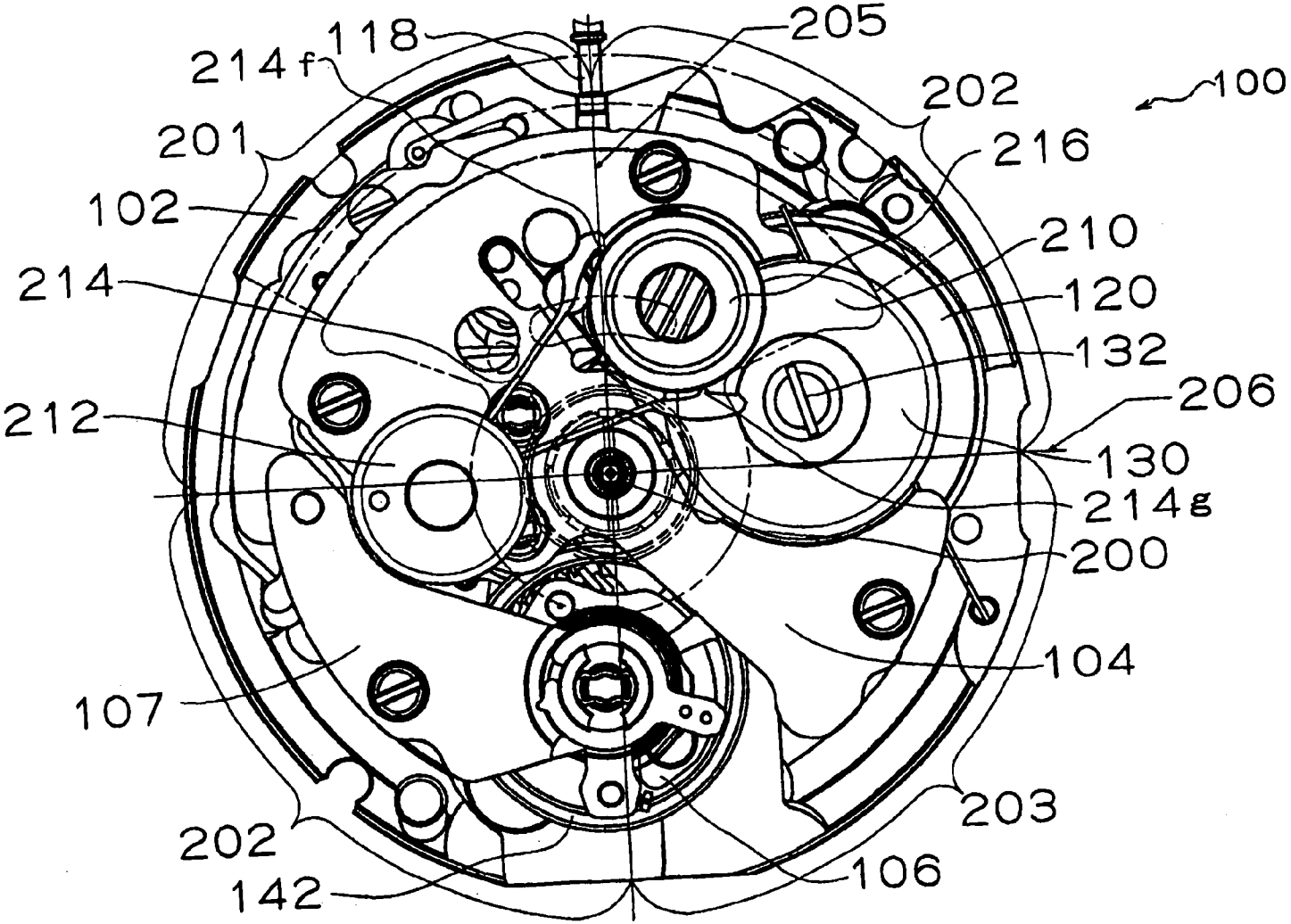
FIG. 2 is a plane view (top plane view) shoving a state of viewing the movement from a side of a case back according to the first embodiment of the timepiece having the mainspring winding state display apparatus of the invention.
Figure 3:
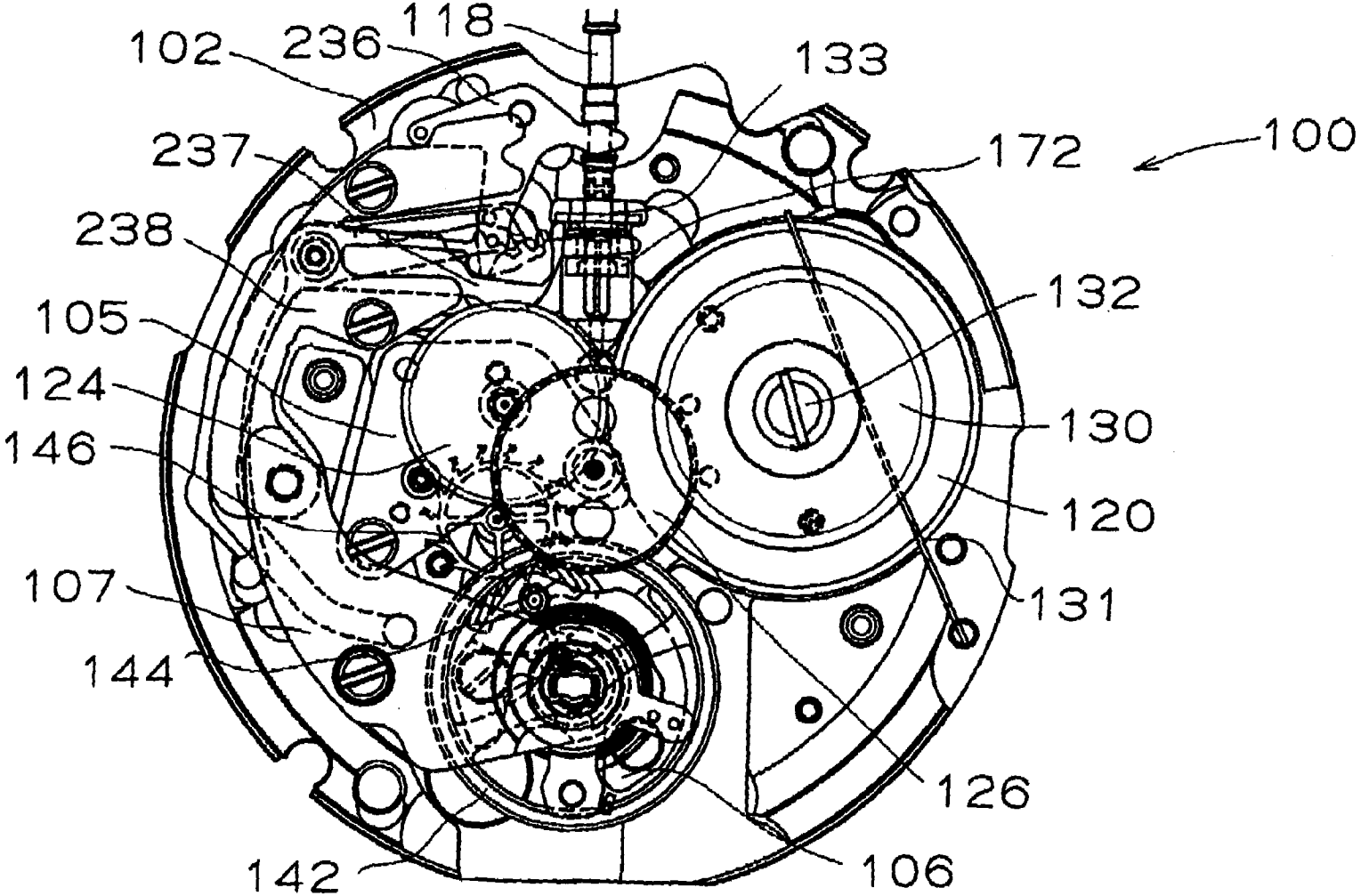
FIG. 3 is a plane view (top plane view) showing a state of viewing the movement having removed a first bridge from the side of the case back according to the first embodiment of the timepiece having the mainspring winding state display apparatus of the invention.

In FIG. 1 and FIG. 2, a main plate reference vertical axis line 205 passing a rotational center 200 of an hour wheel 232 and substantially in parallel with a center axis line of the hand setting stem 118, and a main plate reference horizontal axis line 206 passing the rotational center 200 of the hour wheel 232 and orthogonal to the main plate reference vertical axis line 205 are defined at the main plate 102. The main plate 102 is provided with a first region 201 disposed on one side of the main plate reference vertical axis line 205 and disposed on a side of the main plate reference horizontal axis line 206 proximate to the hand setting stem 118, a second region 202 disposed on other side of the main plate reference vertical axis line 205 and disposed on a side of the main plate reference horizontal axis line 206 proximate to the hand setting stem 118, a third region 203 disposed on other side of the main plate reference vertical axis line 205 where the second region 202 is present and disposed on a side of the main plate reference horizontal axis line 206 remote from the hand setting stem 118, and a fourth region 204 disposed on the one side of the main plate reference vertical axis line 205 where the first region 201 is present and disposed on a side of the main plate reference horizontal axis line 206 remote from the hand setting stem 118. In FIG. 1, although the first region 201 and the fourth region 204 are present on a right side of the main plate reference vertical axis line 205, the first region 201 and the fourth region 204 may be defined to be disposed on a left side of the main plate reference vertical axis line 205. In this case, the second region 202 and the third region 203 are defined to dispose on a right side of the main plate reference vertical axis line 205. Further, according to the embodiment of the timepiece having the mainspring winding state display apparatus of the invention, an arrangement of a part in the movement may be arranged as illustrated, or may be arranged to constitute line symmetry (mirror image) relative to the arrangement illustrated by constituting an axis of symmetry by the main plate reference vertical axis line 205.

(1•2) Constitution of a Top Train Wheel

Next, a constitution of a top train wheel will be explained. In reference to FIG. 2 through FIG. 4, the barrel complete 120 is rotatably supported by the barrel bridge 104 and the main plate 102. The barrel complete 120 includes a mainspring 120*b*, a barrel stem 120*c*, a barrel gear 120*d*, and a barrel lid 120*f*. The mainspring 120*b* constitutes a power source of the mechanical timepiece. By winding back (releasing) the mainspring 120*b*, the barrel gear 120*d* is rotated in one direction and indicates time information by indicators (hour hand, minute hand, second and the like) via rotation of the top train wheel and a back train wheel. Rotation of the barrel gear 120*d* rotated by power of the mainspring 120*b* is controlled by a speed control apparatus and an escaping apparatus. The speed control apparatus includes a barrel with hairspring 142. The escaping apparatus includes a pallet fork 144 and an escape wheel & pinion 146. The balance with hairspring 142 is rotatably supported by the barrel bridge 107 and the main plate 102. The pallet fork 144 is rotatably supported by the pallet fork bridge 106 and the main plate 102. The escape wheel & pinion 146 is rotatably supported by the first bridge 104 and the main plate 102. A center wheel & pinion 122 is constituted to be rotated by one rotation per hour by rotation of the barrel gear 120*d*. The center wheel & pinion 122 is rotatably supported by the second bridge 105 and the main plate 102. A third wheel & pinion 124 is constituted to be rotated by rotation of the center wheel & pinion 122.

The third wheel and pinion 124 is rotatably supported by the first bridge 104 and the main plate 102. A second wheel & pinion 126 is constituted to be rotated by one rotation per minute by rotation of the third wheel & pinion 124. The second wheel & pinion 126 is rotatably supported by the first bridge 104 and the main plate 102. A rotational speed of the second wheel & pinion 126 is constituted to be controlled by the escape wheel & pinion 146. A rotational speed of the escape wheel & pinion 146 is constituted to be controlled by the pallet fork 144. Pivoting movement of the pallet fork 144 is constituted to be controlled by the balance with hairspring 142. The top train wheel includes the center wheel & pinion 122, the third wheel & pinion 124 and the second wheel & pinion 126. A minute hand 246 attached to the center wheel & pinion 122 is constituted to indicate "minute". A second hand 248 attached to the second wheel & pinion 126 is constituted to indicate "second". A rotational center of the second wheel & pinion 126 and a rotational center of the center wheel & pinion 122 are constituted to be disposed at the same position. A square hole portion of the ratchet wheel 130 is integrated to a square shaft portion 120*h* provided at an upper portion (a side of the first bridge 104) of the barrel stem 120*c* of the barrel complete 120. The ratchet wheel 130 is supported to be rotated integrally with the barrel stem 20*c* by a square hole stop screw 132. The ratchet wheel 130 can be rotated only in the same direction as a direction of rotating the barrel complete 120. A click 131 constituting a rotation rectifying member is provided at the first bridge 104 for rectifying rotation of the ratchet wheel 130 only in one direction. The ratchet wheel 130 can be hampered from being rotated in a direction opposed to the direction of rotating the barrel complete 120 by the click 131. According to a constitution for providing a hand winding mechanism, the hand winding mechanism includes a clutch wheel 272, a winding pinion 133, a crown wheel 134 and a crown transmission wheel 135. The winding pinion 133 is constituted to be rotated by rotation of the clutch wheel 272 in one direction. The crown transmission wheel 135 is constituted to be rotated by rotation of the winding pinion 133 via rotation of the crown wheel 134. The ratchet wheel 130 is constituted to be rotated in the clockwise direction by the rotation of the crown transmission wheel 135. The balance with hairspring 120*b* is constituted to be able to be wound by the rotation of the ratchet wheel 130.

(1•3) Constitution of an Automatic Winding Mechanism

Figure 4:
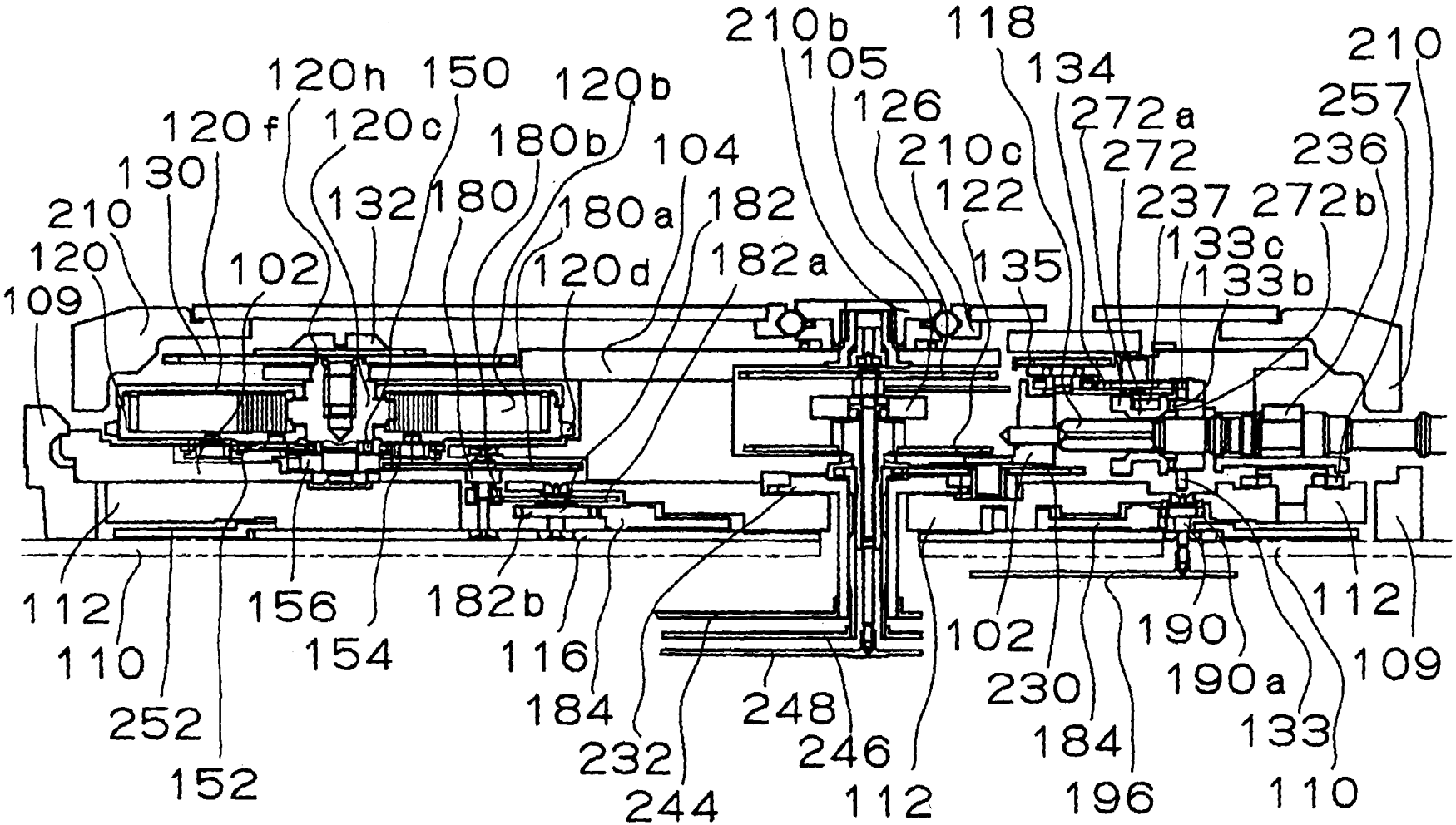
FIG. 4 is a partial sectional view showing a portion of the movement according to the first embodiment of the timepiece having the mainspring winding state display apparatus of the invention.

Next, a constitution of an automatic winding mechanism will be explained. In FIG. 2 and FIG. 4, an automatic winding mechanism for winding up the balance with hairspring 120*b* is provided on the top side of the movement 100. The automatic winding mechanism includes an oscillating weight 210, a first transmission wheel 212, a pawl lever 214 and a second transmission wheel 216. The oscillating weight 210 is rotatably integrated to the first bridge 104 via a ball bearing 210*b*. The first transmission wheel 212 is rotatably supported by the first bridge 104 and the main plate 102. A gear portion of the first transmission wheel 212 is constituted to be brought in mesh with an oscillating weight pinion 210*c* of the oscillating weight 210. A hole (not illustrated) of a base portion of the pawl lever 214 is rotatably integrated to an eccentric cam portion (not illustrated) of the first transmission wheel 212. The pawl lever 214 includes two pawl portions, that is, a pull pawl 214*f* and a push pawl 214*g*. The second transmission wheel 216 is rotatably supported by the first bridge 104. The pull pawl 214*f* and the push pawl 214*g* of the pawl lever 214 are constituted to be brought in mesh with ratchet teeth (not illustrated) of the second transmission wheel 216. When the oscillating weight 210 is rotated, the pawl lever 214 is constituted to be operated by rotating the first transmission wheel 212. The pull pawl 214*f* of the pawl lever 214 is constituted to be able to rotate the second transmission wheel 216 only in one direction (counterclockwise direction in FIG. 2). The push pawl 214*g* of the pawl lever 214 is constituted to be able to rotate the second transmission wheel 216 only in one direction (counterclockwise direction in FIG. 2). Therefore, when the oscillating weight 210 is rotated, the pawl lever 214 is operated, and the ratchet wheel 130 is constituted to be rotated in the clockwise direction based on rotation of the second transmission wheel 216. As a result, when the oscillating weight 210 is rotated, the balance with hairspring 210*b* can be wound up by operating the automatic winding mechanism.

(1•4) Constitution of a Back Train Wheel

Next, a constitution of a back train wheel will be explained. In reference to FIG. 4, a back train wheel includes a minute wheel 230 and an hour wheel 232. The minute wheel 230 is constituted to be rotated by rotation of the center wheel and pinion 122. The hour wheel 232 is constituted to be rotated by one rotation per 12 hours by rotation of the minute wheel 230. An hour hand 244 attached to the hour wheel 232 indicates "hour". A rotational center of the hour wheel 232 and a rotational center of the center wheel & pinion 122 are constituted to be disposed at the same position. It is preferable to arrange the rotational center of the minute wheel 230 on the main plate reference vertical axis line 205.

(1•5) Constitution of a Switching Mechanism

Next, a constitution of a switching mechanism will be explained. According to the timepiece of the invention, the switching mechanism and a time setting mechanism are provided in order to set time of the timepiece. In reference to FIG. 3, the switching mechanism is constituted to include a setting lever 236, a yoke 237 and a yoke holder 238. The time setting mechanism includes a hand setting stem 118 and a clutch wheel 272. The square hole portion of the clutch wheel 272 is integrated to the square shaft portion of the hand setting stem 118. A position of the hand setting stem 118 in a direction along a center axis line of the hand setting stem 118 is determined by a switching apparatus (setting lever, yoke and the like). A position of the clutch wheel 272 in the direction along the center axis line of the hand setting stem 118 is determined by the switching apparatus (setting lever, yoke, yoke holder and the like). The clutch wheel 272 includes an A tooth 272*a* disposed on a side proximate to a center portion of the movement 100 and a B tooth 272*b* disposed on a side proximate to an outer shape portion of the movement 100. The B tooth 272*b* of the clutch wheel 272 is constituted by a ratchet gear. The winding pinion 133 includes a winding small gear 133*b* constituted to be able to be brought in mesh with the B tooth 272*b* of the clutch wheel 272 and a winding large gear 133*c* constituted to be able to be brought in mesh with a gear portion of the crown wheel 134. The winding small gear 133*b* is constituted by a ratchet gear.

In a state of setting the hand setting stem 118 to 0 stage and in a state of setting the hand setting stem 118 to 1 stage, the A tooth 272*a* of the clutch wheel 272 is constituted not to be brought in mesh with the gear portion of the minute wheel 230. In the state of setting the hand setting stem 118 to 0 stage and in the state of setting the hand setting stem 118 to 1 stage, the B tooth 272*b* of the clutch wheel 272 is constituted to be brought in mesh with the small gear 133*b* of the winding pinion 133. In a state of setting the hand setting stem 118 to 2 stage, the A tooth 272*a* of the clutch wheel 272 is constituted to be brought in mesh with the gear portion of the hour wheel 230. In the state of setting the hand setting stem 118 to 2 stage, the A tooth 272*a* of the clutch wheel 272 is constituted not to be brought in mesh with the small gear 133*b* of the winding pinion 133. When the hand setting stem 118 is rotated in one direction in the state of setting the hand setting stem 118 to 0 stage, the mainspring 120*b* is constituted to be able to be wound up by rotating the clutch wheel 272 along with the hand setting stem 118 and rotating the ratchet wheel 130 via rotation of the winding pinion 133, the crown wheel 134 and the crown transmission wheel 135. When the hand setting stem 118 is rotated in other direction in the state of setting the hand stetting stem 118 to 0 stage, although the clutch wheel 272 is rotated along with the hand setting stem 118, the winding pinion 133 is constituted not to be rotated.

(1•6) Constitution of a Calendar Mechanism

Next, a constitution of a calendar mechanism will be explained. According to the timepiece having a calendar, a date indicator feeding mechanism is constituted to be operated based on rotation of the back train wheel. The date indicator feeding mechanism includes a date indicator driving wheel 250, an intermediate date indicator driving wheel 251 and a date indicator 252. The intermediate date indicator driving wheel 251 is constituted to be rotated by rotation of the hour wheel 232. The date indicator driving wheel 250 is constituted to be rotated by rotation of the intermediate date indicator driving wheel 251. The date indicator 252 is constituted to be rotated by (1/31) once per day by a date feeding pawl 250*b* provided at the date indicator driving wheel 250. The date indicator 252 is constituted to be rotated by one rotation per 31 days. A position in a rotational direction of the date indicator 252 is rectified by a date jumper 253. Date characters 252*c* from "1" to "31" provided at the date indicator 252 are constituted to indicate "date" (refer to FIG. 5).

(1•7) Constitution of a Date Correcting Mechanism

Next, a constitution of a date correcting mechanism will be explained. The timepiece of the invention can be provided with a date correcting mechanism for correcting display of date by the date indicator 252. In reference to FIG. 1 and FIG. 4, the date correcting mechanism is constituted by the clutch wheel 272, the winding pinion 133, a first corrector transmission setting wheel 257, a first corrector transmission setting wheel 258 and a corrector setting wheel 259. When the hand setting stem 118 is rotated in one direction in a state of setting the hand setting stem 118 to 1 stage, the clutch wheel 272 is rotated, the corrector setting wheel 259 is pivoted in one direction to stop at a first position via rotation of the winding pinion 133 and the first corrector transmission setting wheel 257, and is constituted to be able to rotate the date indicator 252 by rotating the corrector setting wheel 259 at the first position. The date indicator 252 is constituted not to be able to be rotated even when the hand setting stem 118 is rotated in other direction in the state of setting the hand setting stem 118 to 1 stage.

(1•8) Constitution of a Mainspring Winding State Display Mechanism

Next, a constitution of a mainspring winding state display mechanism will be explained. The mainspring winding state display mechanism includes a planetary mechanism. In reference to FIG. 1 and FIG. 4, the planetary mechanism constitutes a speed reducing mechanism cooperatively moved with a barrel gear 120*d* for reducing the speed of rotation of the barrel gear 120*d*. The planetary mechanism includes a first sun wheel 150, a first planetary wheel 152, a second planetary wheel 154 and a second sun wheel 156. The first sun wheel 150 is fixed to a lower shaft portion 120*h* provided at a lower middle portion of a barrel stem 120*c* of the barrel complete 120 (portion on a side of the main plate 102 and on a side most proximate to a bottom face of the barrel gear 120*d*. The first planetary wheel 152 is attached rotatably to the bottom face of the barrel gear 120*d*. The second planetary wheel 154 is rotatably attached to the bottom face of the barrel gear 120*d*. The second sun wheel 156 is rotatably attached to a lower front end shaft portion of the barrel stem 120*c* of the barrel complete 120 (portion mostly proximate to the main plate 102). The first sun wheel 150 is constituted to be brought in mesh with the first planetary wheel 152. The first planetary wheel 152 is constituted to be brought in mesh with the second planetary wheel 154. The second planetary wheel 154 is constituted to be brought in mesh with the second sun wheel 156. When the barrel gear 120*d* is rotated, the first planetary wheel 152 is constituted to be able to be rotated while revolving around the first sun wheel 150. When the barrel gear 120*d* is rotated, the second planetary wheel 154 is constituted to be able to be rotated while revolving around the first sun wheel 150. It is preferable to arrange a rotational center of the first sun wheel 150 at the second region 202.

A first winding mark intermediate wheel 180 is rotatably supported by the main plate 102 and the date indicator maintaining plate 116. The first winding mark intermediate wheel 180 includes a first winding mark intermediate gear 180*a* and a first winding mark intermediate pinion 180*b*. It is preferable to arrange a rotational center of the first winding mark intermediate wheel 180 at the third region 203. A second winding mark intermediate wheel 182 is rotatably supported by the second main plate 112 and the date indicator maintaining plate 116. The second winding mark intermediate wheel 182 includes a second winding mark intermediate gear 182*a* and a second winding mark intermediate pinion 182*b*. It is preferable that a rotational center of the second winding mark intermediate wheel 182 is arranged at the third region 203. A winding mark drive wheel 184 is rotatably supported by the second main plate 112. The winding mark drive wheel 184 is arranged between the second main plate 112 and the date indicator maintaining plate 116. The winding mark drive wheel 184 includes a first segment portion 184*b* and a second segment portion 184*f*. A first segment gear 184*c* is provided at the first segment portion 184*b*. A second segment 184*g* is provided at the second segment portion 184*f*. It is preferable to constitute an outer diameter (pitch diameter) of the first segment gear 184*c* to be a dimension larger than an outer diameter (pitch diameter) of the second segment gear 184*g*. It is preferable that an opening angle of the first segment gear 184*c* is about 25 degrees. It is preferable that an opening angle of the second segment gear 184*g* is about 50 degrees. The winding mark drive wheel 184 constitutes a "deformed segment gear" having the two segment gears having the different outer diameters (pitch diameters). The first segment gear 184*c* is constituted to be brought in mesh with the second winding mark intermediate gear 182*a*.

A winding mark indicator 190 is rotatably supported by the second main plate 112 and the date indicator maintaining plate 116. The winding mark indicator 190 includes a winding mark gear 190*a*. The winding mark gear 190*a* is constituted to be brought in mesh with the second segment gear 184*g*. A rotational center of the winding mark indicator 190 is arranged at a region on the main plate reference vertical axis line 205 and on a side proximate to the hand setting stem 118 (3 o'clock direction of the dial 110). It is preferable that a rotational center of the winding mark driving wheel 184 is arranged in a region on the main plate reference vertical axis line 205 and proximate to the hand setting stem 118. It is preferable that a rotational center of the winding mark drive wheel 184 is arranged at a region between the rotational center of the winding mark indicator 190 and a rotational center of the hour wheel 232. A winding mark hand 196 constituting a mainspring winding state display member is attached to a winding mark indicator stem of the winding mark indicator 190. When a mainspring winding state is intended to display by constituting a rotational center by a position in 3 o'clock direction of the dial 110 in the movement 100, the winding stem hand 196 constituting the main spring winding state display member is attached to the winding mark indicator stem of the winding mark indicator 190. According to the constitution, in reference to FIG. 5, a display sign 110*a* indicating a mainspring winding state is provided at the dial 110. For example, the display sign 110*a* includes numerals of "0", "20", "40", "60". The user can know a state of winding the mainspring by a position of a front end of the winding mark hand 196 and the display sign 110*a*. By the constitution, the rotational center of the winding mark hand 196 (that is, rotational center of power reserve indicator) can be arranged at an arbitrary pertinent position in the movement 100 of the timepiece regardless of a position of the rotational center of the barrel gear 120*d*. Further, by the constitution, an influence of backlashes of mesh among the gears for transmitting rotation to the winding mark hand 196 can be reduced and operation of the winding mark hand 196 can effectively be prevented from being retarded.

(1•9) Operation of Winding Up a Mainspring

In reference to FIG. 1 through FIG. 4, in a state of completely winding back the mainspring 120*b*, by rotating the automatic winding train wheel, the ratchet wheel 130 is rotated in the clockwise direction. Under the state, rotation of the barrel gear 120*d* is rectified by the center wheel & pinion 122. Under the state, the barrel stem 120 and the first sun wheel 150 are rotated by rotation of the ratchet wheel 130. The first planetary wheel 152 is rotated (only rotation) by rotation of the first sun wheel 150. The second planetary wheel 154 is rotated (only rotation) by rotation of the first sun wheel 152. The second sun wheel 156 is rotated by rotation of the second planetary wheel 154. The first winding mark intermediate wheel 180 is rotated by rotation of the second sun wheel 156. The second winding mark intermediate wheel 182 is rotated by rotation of the first winding mark intermediate wheel 180. The winding mark drive wheel 184 is rotated by rotation of the second winding mark intermediate wheel 182. The winding mark indicator 190 is rotated in the clockwise direction by rotation of the winding mark drive wheel 184.

Therefore, as winding up the mainspring 120*b*, the winding mark hand 196 is rotated in the clockwise direction, the winding mark hand 196 is brought into a state of indicating "60" of the display sign 110*a* from a state of indicating "0" of the display sign 110*a* by the winding mark hand 196, via a state of indicating "20" of the display sign 110*a* by the winding mark hand 196, further, via a state of indicating "40" by the winding mark hand 196. A state shown in FIG. 5 indicates a state in which the winding mark hand 196 slightly passes a state of "⅔ winding" of the mainspring. In the case of the hand winding timepiece, the mainspring cannot be wound up more than a state of "full winding" by the mainspring. Meanwhile, in the case of the automatic winding timepiece, when the mainspring is going to be wound up more than a state of "full winding" of the mainspring, a portion of a slipping attachment (not illustrated) provided in the barrel complete 120 is slipped. In a state in which the slipping attachment is slipped, by bringing the winding mark indicator 190 into contact with a winding mark indicator degree determining pin (not illustrated), the winding hand 196 can be hampered from being rotated further in the counterclockwise direction.

(1•10) Operation in Normal Hand Movement (In Winding Back a Mainspring)

In reference to FIG. 1 through FIG. 4, in a state of winding up the mainspring, time is indicated by rotating the barrel gear 120*d*. Under the state, the barrel gear 120*d* is rotated in the clockwise direction. Under the state, rotation of the ratchet wheel 130 is rectified by operation of the clip 131 engaged with teeth of the ratchet wheel 130. Therefore, the first sun wheel 150 constitutes "fixed gear" in the planetary gear mechanism. By rotation of the barrel gear 120*d*, the first planetary wheel 152 and the second planetary wheel 154 execute "planetary movement" in which the rotational centers are varied. By the planetary movement of the first planetary wheel 152 and the second planetary wheel 154, the second planetary wheel 156 is rotated. The first winding mark intermediate wheel 180 is rotated by rotation of the second sun wheel 156. The second winding mark intermediate wheel 182 is rotated by rotation of the first winding mark intermediate wheel 180. The winding mark drive wheel 184 is rotated by rotation of the second winding mark intermediate wheel 182. The winding mark display wheel 190 is rotated in the counterclockwise direction by rotation of the winding mark drive wheel 184. Therefore, as winding back (releasing) the mainspring 120*b* by rotating the barrel complete 120, the winding mark hand 196 is rotated in the counterclockwise direction at a speed lower than a normal rotational speed of the train wheel. Therefore, the winding mark hand 196 is brought into the state of indicating "0" of the display sign 110*a* from the state of indicating "60" of the display sign 110*a* by the winding mark hand 196, via the state of indicating "40" of the display sign 110*a* by the winding mark hand 196 and via a state of bringing the winding mark hand 196 into the state of indicating "20" of the display sign 110*a*.

For example, when the winding mark 196 indicates "20", it is shown that a duration is 20 hours, when the winding mark 196 indicates "40", it is shown that the duration is 40 hours, and when the winding mark 196 indicates "60", it is shown that the duration is 60 hours. The display sign 110*a* may be constituted to indicate a "full winding" state of the mainspring by "1", indicate a "half winding" state of the mainspring by "½" and indicate a "release" state of the mainspring by "0". Further, the display sign 110*a* may be constituted to indicate the "full winding" state of the mainspring by "100%", indicate the "half winding" state of the mainspring by "50%" and indicate the "release" state of the mainspring by "0%". Alternately, the display sign 110*a* may be constituted to indicate the "full winding" state of the mainspring by "black circle sign", indicate the "half winding" state of the mainspring by "semicircle sign" and indicate the "release" state of the mainspring by "white circle sign".

(1•11) Explanation of Complete

Figure 5:
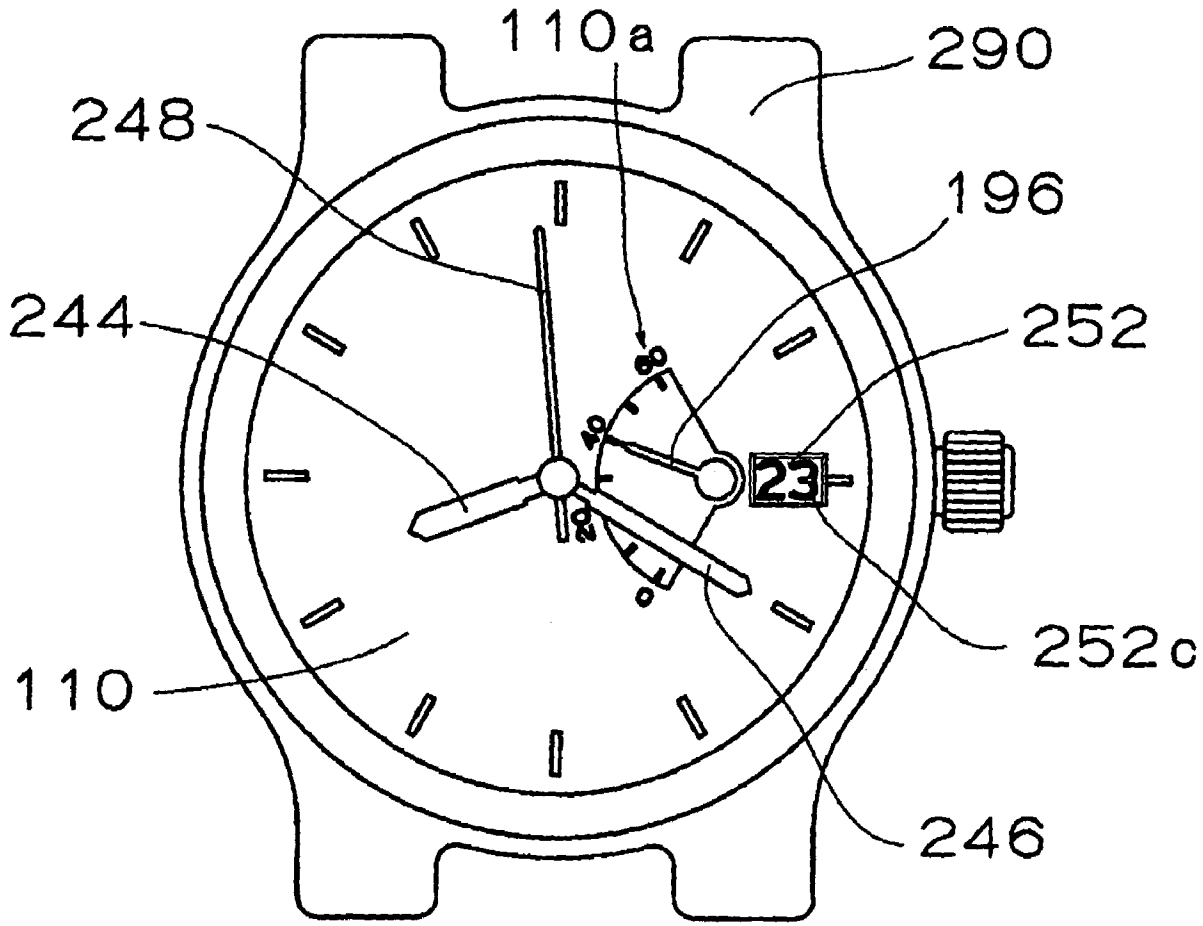
FIG. 5 is a plane view showing an outlook of a complete in a state in which the mainspring is wound back to a middle location according to the first embodiment of the timepiece having the mainspring winding state display apparatus of the invention.

In reference to FIG. 5, a complete of the timepiece having the mainspring winding state display apparatus of the invention includes a timepiece case 290. The movement 100 of the timepiece having the mainspring winding state display apparatus is contained in the timepiece case 290. "Hour" of the current time is indicated by the hour hand 244. "Minute" of the current time is indicated by the minute hand 246. "Second" of the current time is indicated by the second hand 248. Current "date" is indicated by the date character 252*c* provided at the date indicator 252. The display sign 110*a* provided at the dial 110 indicates the duration capable of operating the timepiece having the mainspring winding state display apparatus. In FIG. 5, the winding mark hand 196 indicates a position of slightly passing "40" of the display sign 110*a*. The state shows that the duration of the mainspring is equal to or longer than 40 hours. An angle of rotating the winding mark hand 196 from the "full winding" state of the mainspring is constituted to correspond to the duration of the timepiece. As has been explained above, according to the timepiece having the mainspring winding state display apparatus of the invention, the duration of the timepiece can be indicated very comprehensively.

(2) Second Embodiment

Figure 6:
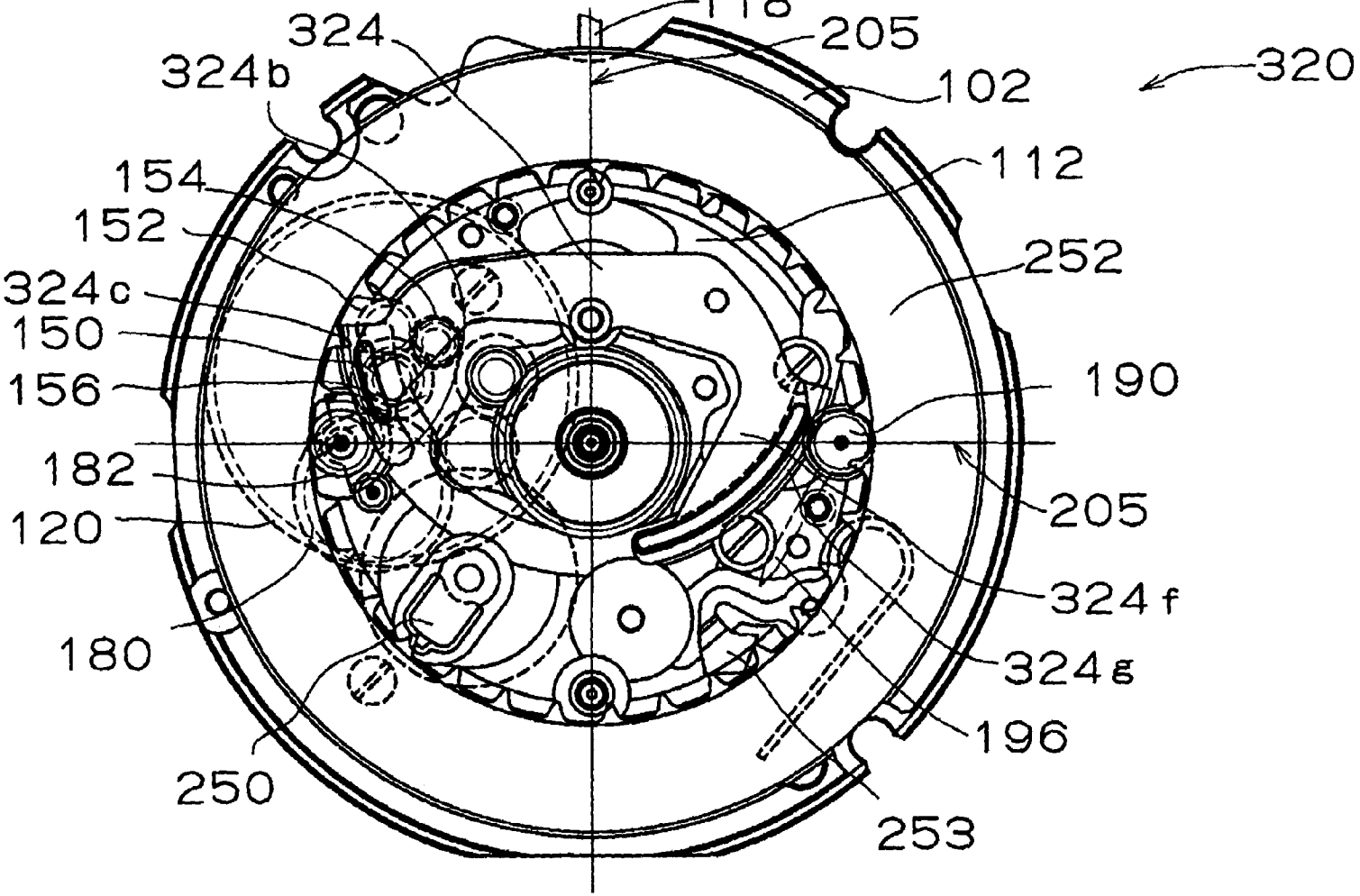
FIG. 6 is a plane view (back plane view) showing a state of viewing a movement in a state in which a mainspring is release from a side of a dial according to a second embodiment of a timepiece having a mainspring winding state display apparatus of the invention.
Figure 7:
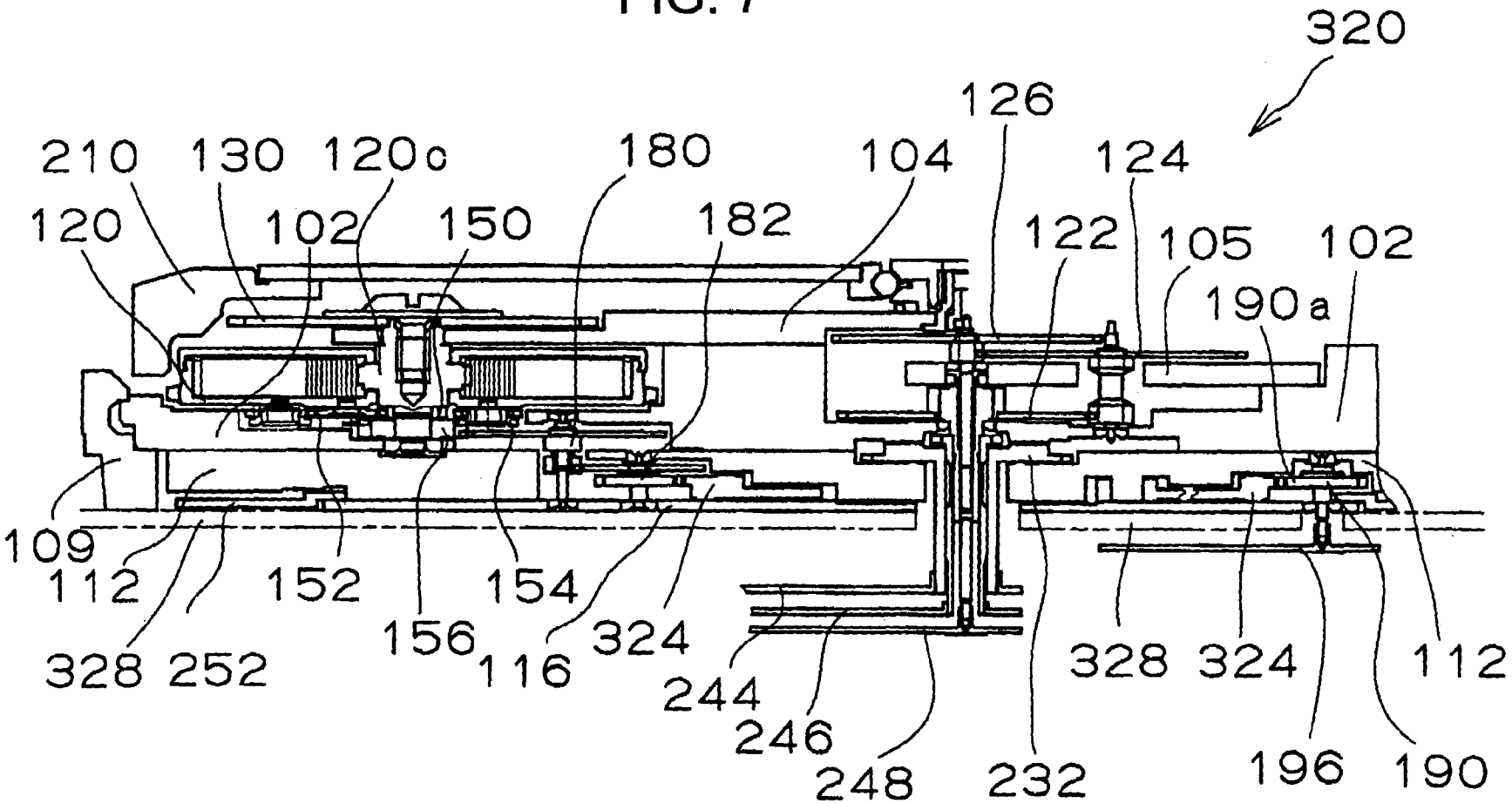
FIG. 7 is a partial sectional view showing a portion of the movement according to the second embodiment of the timepiece having the mainspring winding state display apparatus of the invention.

Next, a second embodiment of a timepiece having a mainspring winding state display apparatus of the invention will be explained. In the following explanation, a description will mainly be given of points of the second embodiment of the timepiece having the mainspring winding state display apparatus of the invention different from the first embodiment of the timepiece having the mainspring winding state display apparatus of the invention. Therefore, the above-described explanation of the first embodiment of the timepiece having the mainspring winding state display apparatus will be applied to a portion which is not described in the following. In reference to FIG. 6 through FIG. 8, according to the second embodiment of the timepiece having the mainspring winding state display apparatus of the invention, in a movement 320 of the timepiece having the mainspring winding state display apparatus, the rotational center of the winding mark display wheel 190 is arranged in a region on the main plate reference horizontal axis line 206 in 6 o'clock direction of the dial 110. A winding mark drive wheel 324 is rotatably supported by the second main plate 112. It is preferable that a rotational center of the winding mark drive wheel 324 is arrange data region on the main plate reference vertical axis line 205 in 3 o'clock direction of the dial 110. It is preferable that the rotational center of the winding mark drive wheel 324 is arranged at a region between a rotational center of the winding mark display wheel 190 and a rotational center of the hour wheel 232. The winding mark drive wheel 324 includes a first segment portion 324*b* and a second segment portion 324*f*. A first segment gear 324*c* is provided at the first segment portion 324*b*. It is preferable to constitute an outer diameter (pitch diameter) of the first segment gear 324*c* to be a dimension substantially the same as an outer diameter (pitch diameter) of a second segment gear 324*g*. The outer diameter (pitch diameter) of the first segment gear 324*c* may be constituted to differ from the outer diameter (pitch diameter) of the second segment gear 324*g*. It is preferable that an opening angle of the first segment gear 324*c* is about 25 degrees. The second segment gear 324*g* is provided at the second segment portion 324*f*. It is preferable that an opening angle of the second segment gear 324*g* is about 60 degrees.

The winding mark drive wheel 324 constitutes "deformed segment gear" including the two segment gears. The first segment gear 324*c* is constituted to be brought in mesh with the second winding mark intermediate gear 182*a*. The winding mark indicator 190 is rotatably supported by the second main plate 112 and the date indicator maintaining plate 116. The winding mark indicator 190 includes a winding mark gear 190*a*. The second segment gear 324*g* is constituted to be brought in mesh with the winding mark gear 190*a*. By the constitution, a rotational center of the winding mark hand 196 (that is, rotational center of a power reserve indicator) can be arranged at an arbitrary pertinent position in the movement of the timepiece regardless of the position of the rotational center of the barrel gear 120*d*. Further, by the constitution, an influence of backlashes of mesh among gears for transmitting rotation to the winding mark hand 196 can be reduced, and operation of the winding mark hand 196 can effectively be prevented from being retarded. The second main plate 112, the date indicator holder 116, and the winding mark indicator 190 are constituted to be able to integrate the winding mark display wheel 190 at a plurality of positions to be able to be applied to both the first embodiment and the second embodiment of the timepiece having the mainspring winding state display apparatus of the invention. It is preferable to constitute the second main plate 112 to be able to integrate the winding mark indicator 190 at other position so as to be able to be applied also to a constitution for providing the winding mark indicator 190 at other position. According to the invention, the mainspring winding state can be displayed by the winding mark hand 196 by constituting the rotational center by a plurality of positions by using the single movement and therefore, timepieces having a plurality of designs can easily be realized.

Figure 8:
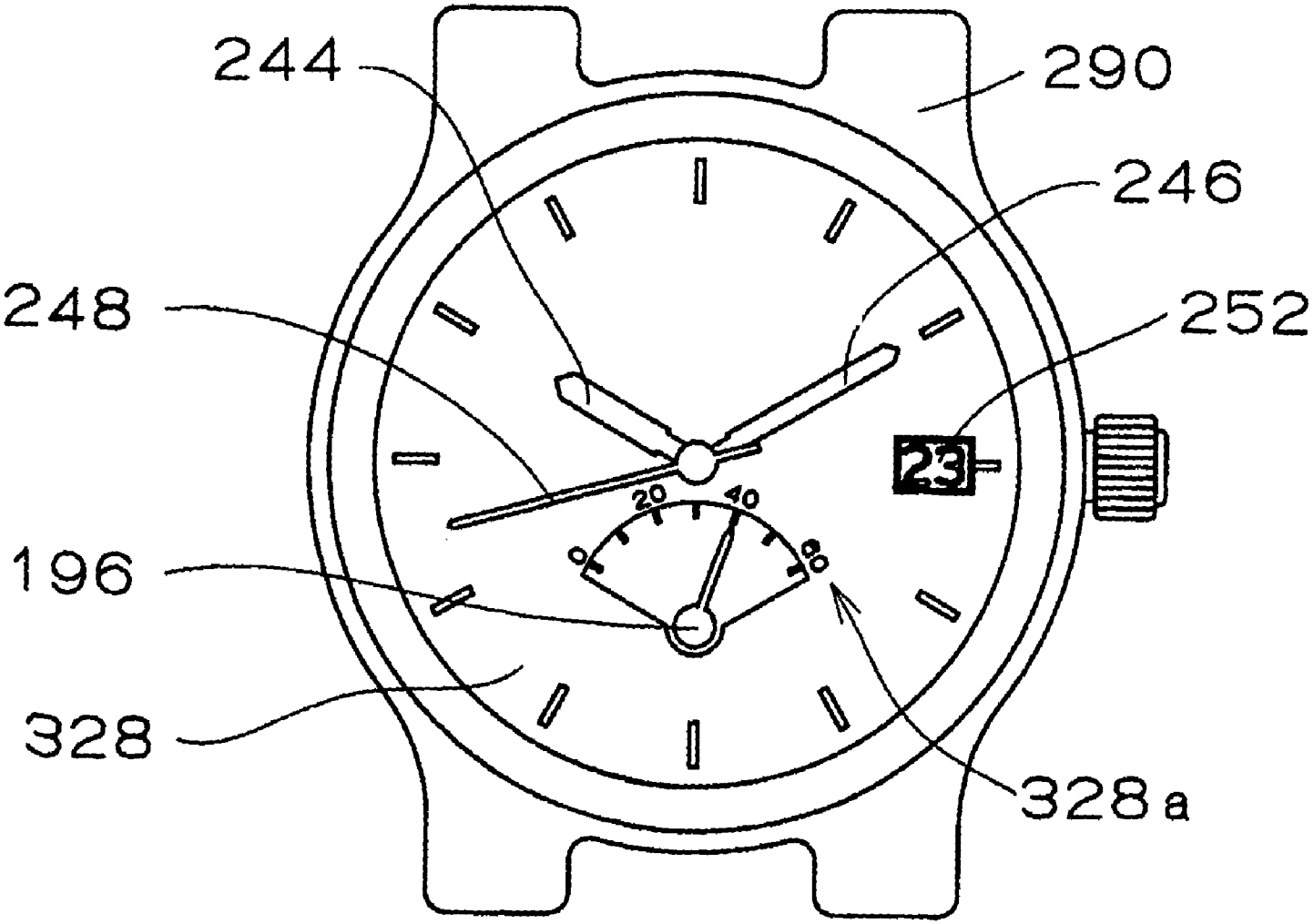
FIG. 8 is a plane view showing an outlook of a complete in a state in which the mainspring is wound back to a middle location according to the second embodiment of the timepiece having the mainspring winding state display apparatus of the invention.

In reference to FIG. 8, the movement 320 of the timepiece having the mainspring winding state display apparatus is contained in the timepiece case 290. A display sign 328*a* provided at a dial 328 indicates a duration capable of operating the timepiece having the mainspring winding state display apparatus. In FIG. 8, the winding mark hand 196 indicates a position of slightly passing "40" of the display sign 328*a*. As has been explained above, according to the timepiece having the mainspring winding state display apparatus of the invention, the duration of the timepiece can be displayed very comprehensively.

(3) Third Embodiment

Figure 9:
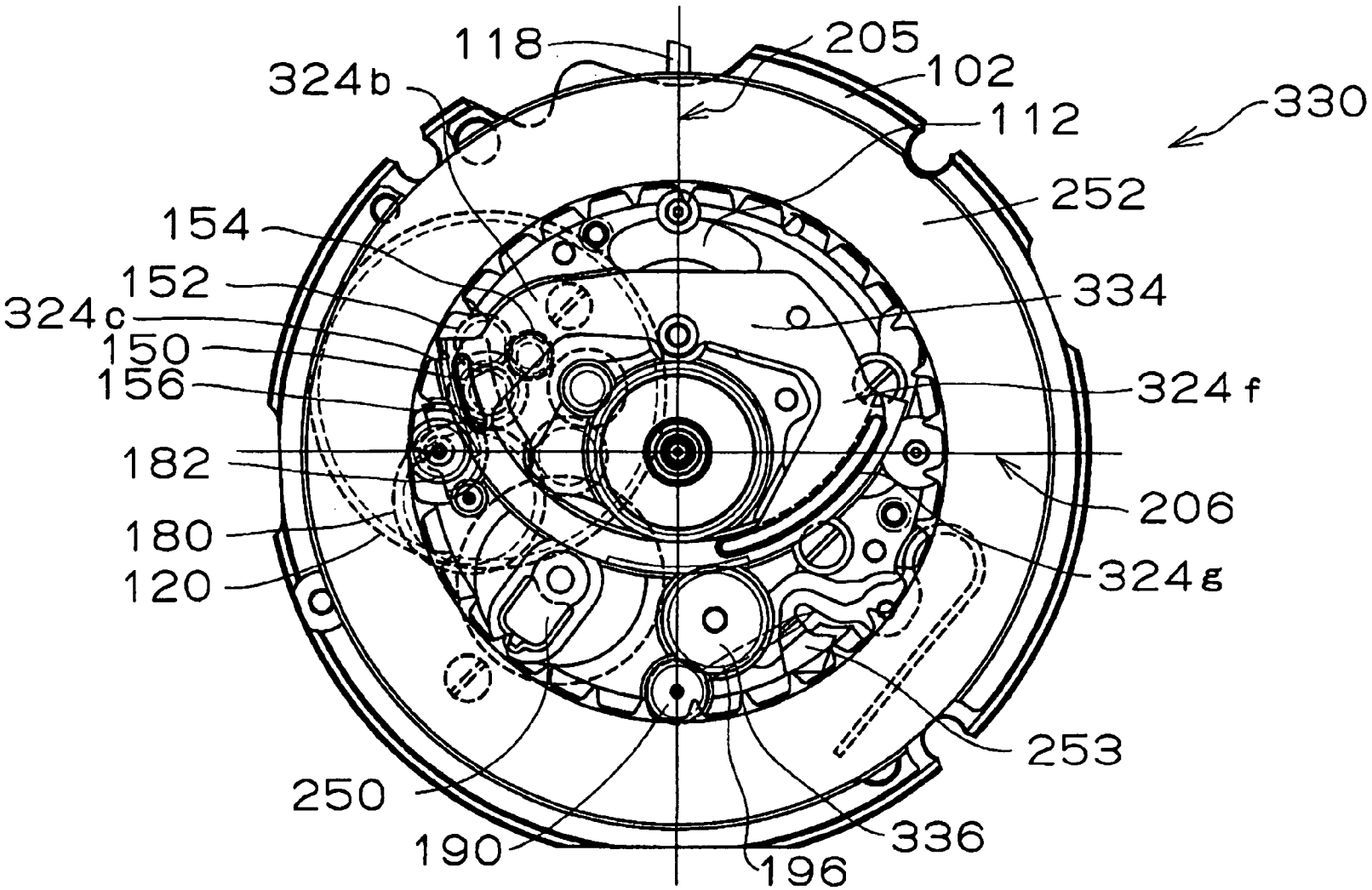
FIG. 9 is a plane view (back plane view) showing a state of viewing a movement in a state in which a mainspring is released from a side of a dial according to a third embodiment of a timepiece having a mainspring winding state display apparatus of the invention.

Next, a third embodiment of a timepiece having a mainspring winding state display apparatus of the invention will be explained. In the following explanation, a description will mainly be given of points of the third embodiment of the timepiece having the mainspring winding state display apparatus of the invention different from the first embodiment of the timepiece having the mainspring winding state display apparatus of the invention. Therefore, the above-described explanation of the first embodiment of the timepiece having the mainspring winding state display apparatus of the invention will be applied to a portion which is not described in the following. In reference to FIG. 9 and FIG. 10, according to the third embodiment of the timepiece having the mainspring winding state display apparatus of the invention, in a movement 330 of the timepiece having the mainspring winding state display apparatus, the rotational center of the winding mark indicator 190 is arranged at a region on the main plate reference vertical axis line 205 and in 9 o'clock direction of the dial 110. A winding mark drive wheel 334 is rotatably supported by the second main plate 112. It is preferable that a rotational center of the winding mark drive wheel 334 is arranged at a region on the main plate reference vertical axis line 205 and in 3 o'clock direction of the dial 110. It is preferable that the rotational center of the winding mark drive wheel 324 is arranged at a region between the rotational center of the winding mark indicator 190 and the rotational center of the hour wheel 232. The winding mark drive wheel 324 includes a first segment portion 324*b* and a second segment portion 324*f*. A first segment gear 324*c* is provided at the first segment portion 324*b*. A second segment gear 324*g* is provided at the second segment portion 324*f*. It is preferable to constitute the outer diameter (pitch diameter) of the first segment gear 324*c* to be a dimension substantially the same as the outer diameter (pitch diameter) of the second segment gear 324*g*. The outer diameter (pitch diameter) of the first segment gear 324*c* may be constituted to differ from the outer diameter (pitch diameter) of the second segment gear 324*g*. It is preferable that the opening angle of the first segment gear 324*c* is about 25 degrees. It is preferable that the opening angle of the second segment gear 324*g* is about 60 degrees.

A winding mark drive transmission wheel 336 is rotatably supported by the second main plate 112. A gear portion of the winding mark drive transmission wheel 336 is constituted to be brought in mesh with the second segment gear 324*g*. The winding mark gear 190*a* is constituted to be brought in mesh with the gear portion of the winding mark drive transmission wheel 336. The winding mark indicator 190 is rotatably supported by the second main plate 112 and the date indicator maintaining plate 116. The winding mark indicator 190 includes the winding mark gear 190*a*. The winding mark gear 190*a* is constituted to be brought in mesh with the second segment gear 324*g*. The second main plate 112, the date indicator maintaining plate 116, the winding mark drive wheel 324 and the winding mark indicator 190 are constituted to be able to integrate the same winding mark indicator 190 in plural positions in order to be able to be applied to both the second embodiment and the third embodiment of the timepiece having the main plate winding state display apparatus of the invention. It is preferable that the second main plate 112 and the date indicator maintaining plate 116 are constituted to be able to integrate the winding mark indicator 190 at other position to be able to be applied also to a constitution for providing the winding mark indicator 190 at other position.

In a state of completely winding back the mainspring 120*b*, when the ratchet wheel 130 is rotated in the clockwise direction by rotation of the automatic winding train wheel, the first winding mark intermediate wheel 180 is rotated via operation of the planetary mechanism. The second winding mark intermediate wheel 182 is rotated by rotation of the first winding mark intermediate wheel 180. The winding mark drive wheel 334 is rotated by rotation of the second winding mark intermediate wheel 182. The winding mark drive transmission wheel 336 is rotated by rotation of the winding mark drive wheel 184. The winding mark indicator 190 is rotated in the counterclockwise direction by rotation of the winding mark drive transmission wheel 336. In a state of winding up the mainspring, the first winding mark intermediate wheel 180 is rotated by rotation of the barrel gear

120*d* via operation of the planetary mechanism. The second winding mark intermediate wheel 182 is rotated by rotation of the first winding mark intermediate wheel 180. The winding mark drive wheel 184 is rotated by rotation of the second winding mark intermediate wheel 182. The winding mark drive transmission wheel 336 is rotated by rotation of the winding mark drive wheel 184. The winding mark indicator 190 is rotated in the clockwise direction by rotation of the winding mark drive transmission wheel 336. Therefore, as winding back (releasing) the mainspring 120*b* by rotating the barrel complete 120, the winding mark hand 196 is rotated in the clockwise direction at a speed slower than a normal rotational speed of the train wheel.

Figure 10:
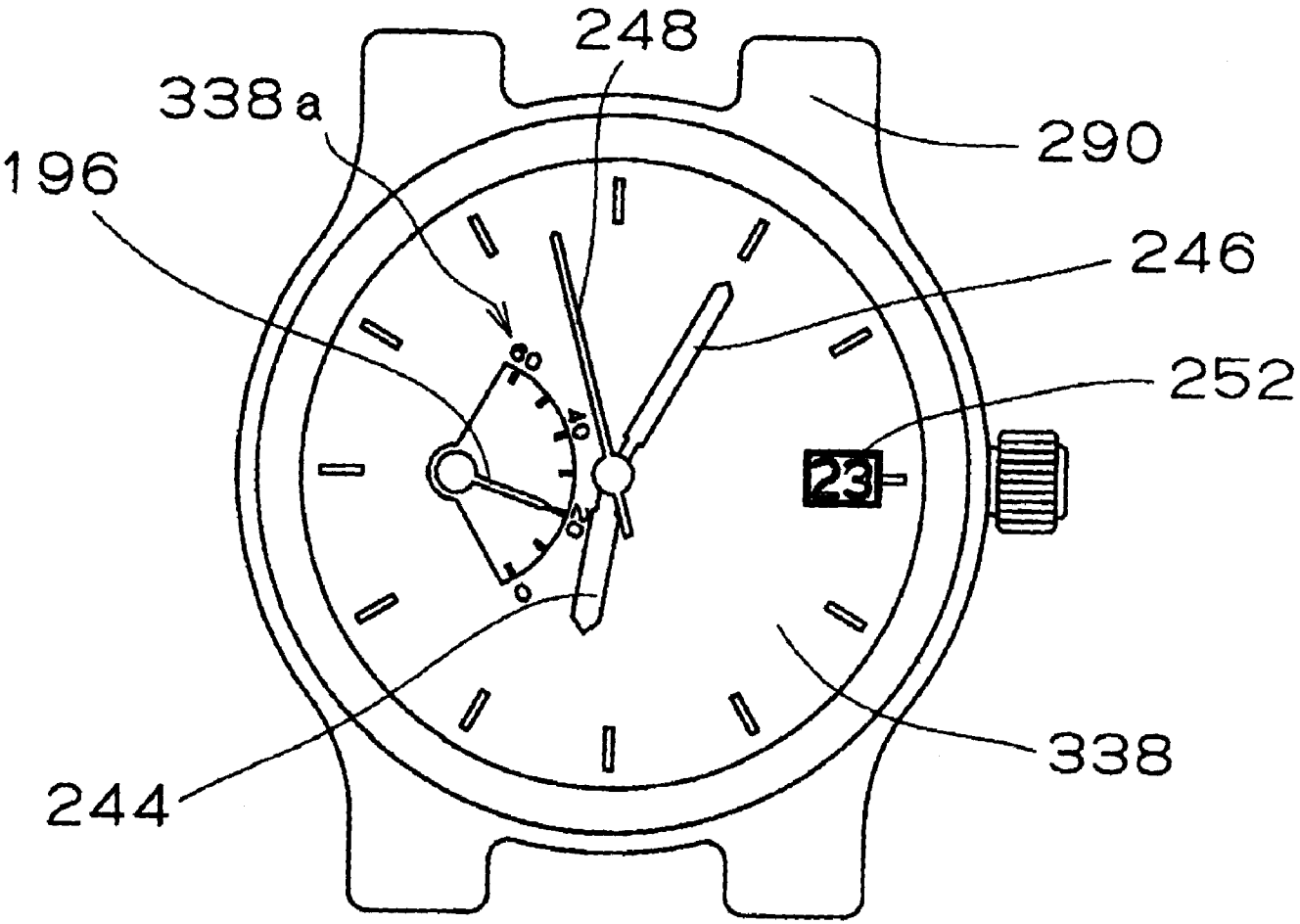
FIG. 10 is a plane view showing an outlook of a complete in a state in which the mainspring is wound back to a middle location according to the third embodiment of the timepiece having the mainspring winding state display apparatus of the invention.

The winding mark drive wheel 334 constitutes "deformed segment gear" having two segment gears having the outer diameters (pitch diameters) of substantially the same dimension. By the constitution, the rotational center of the winding mark hand 196 (that is, rotational center of the power reserve indicator) can be arranged at an arbitrary pertinent position in the movement of the timepiece regardless of the position of the rotational center of the barrel gear 120*d*. Further, by the constitution, an influence of backlashes of mesh among gears for transmitting rotation to the winding mark hand 196 can be reduced and operation of the winding mark hand 196 can effectively be prevented from being retarded. Therefore, according to the invention, by using the single movement, the mainspring winding state can be displayed by constituting the rotational center by a plurality of positions and therefore, timepieces having a plurality of designs can easily be realized. In reference to FIG. 10, the movement 330 of the timepiece having the mainspring winding state display apparatus is contained in the timepiece case 290. A display sign 338*a* provided at a dial 338 indicates a duration capable of operating the timepiece having the mainspring winding state display apparatus. In FIG. 10, the winding hand 196 indicates a position slightly passing "40" of the display sign 338*a*. As has been explained above, according to the timepiece having the mainspring winding state display apparatus of the invention, the duration of the timepiece can be displayed very comprehensively.

(4) Fourth Embodiment

Figure 11:
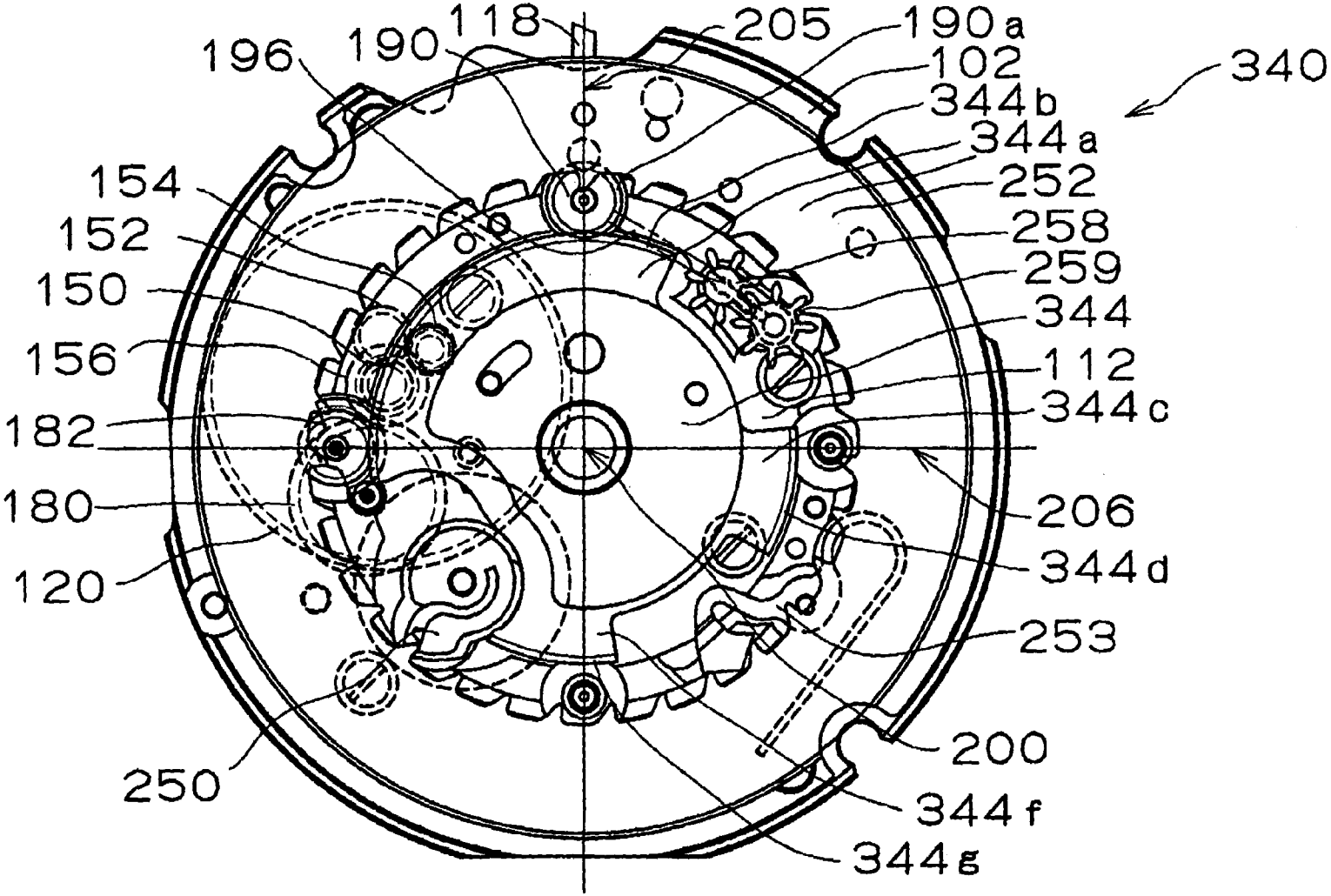
FIG. 11 is a plane view (back plane view) showing a state of viewing a movement in a state in which a mainspring is released from a side of a dial according to a fourth embodiment of a timepiece having a mainspring winding state display apparatus of the invention.
Figure 12:
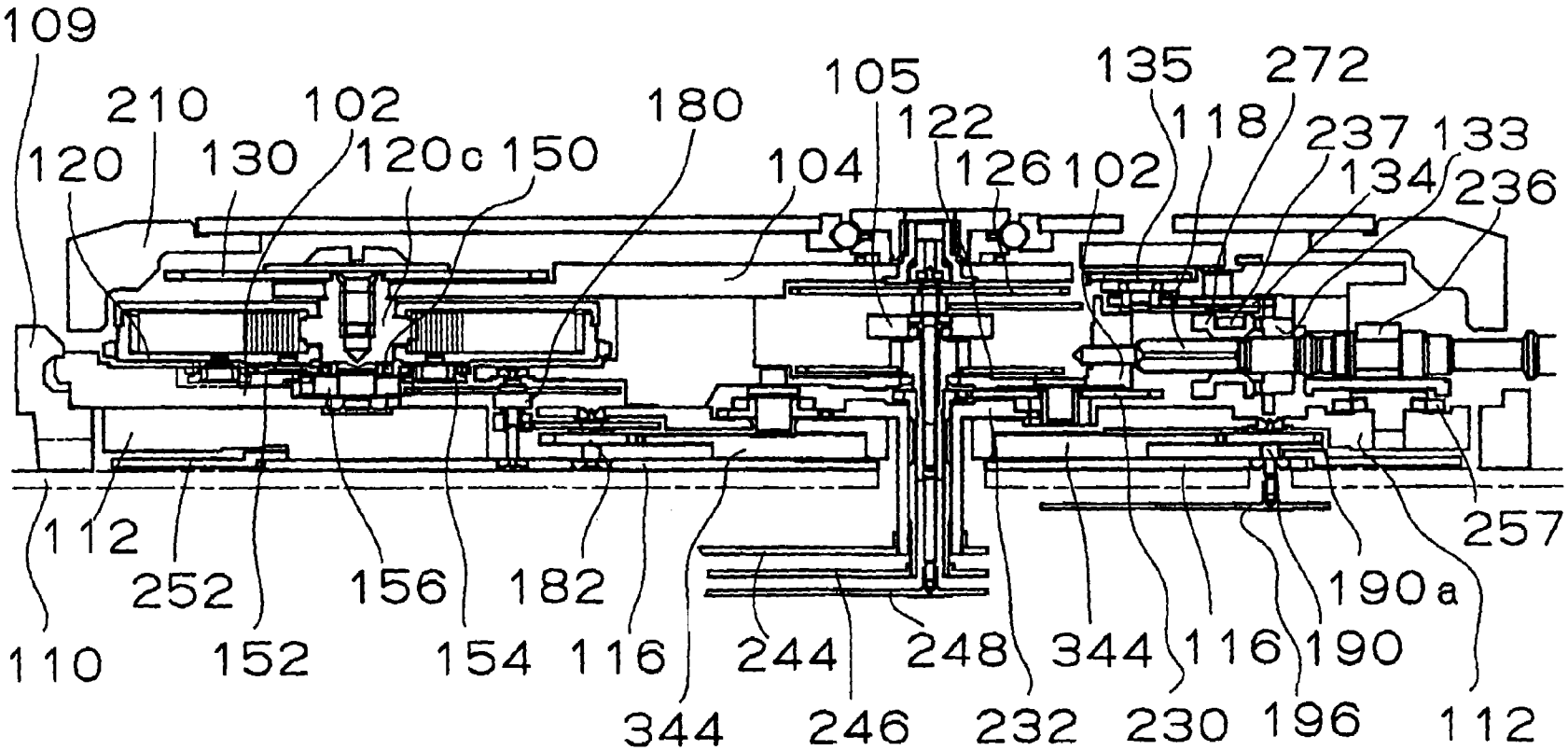
FIG. 12 is a partial sectional view showing a portion of the movement according to the fourth embodiment of the timepiece having the mainspring winding state display apparatus of the invention.

Next, a fourth embodiment of a timepiece having a mainspring winding state display apparatus of the invention will be explained. In the following explanation, a description will mainly be given of points of the fourth embodiment of the timepiece having the mainspring winding state display apparatus of the invention different from the first embodiment of the timepiece having the mainspring winding state display apparatus of the invention. Therefore, the above-described explanation of the first embodiment of the timepiece having the mainspring winding state display apparatus will be applied to a portion which is not described in the following. In reference to FIG. 11 and FIG. 12, according to the fourth embodiment of the timepiece having the mainspring winding state display apparatus of the invention, in a movement 340 of the timepiece having the mainspring winding state display apparatus, the rotational center of the winding display wheel 190 is arranged in a region on the main plate reference vertical axis line 205 and in 3 o'clock direction of the dial 110. A winding mark drive wheel 344 is rotatably supported by the second main plate 112. It is preferable that a rotational center of the winding mark drive wheel 344 is arranged at the same position as the rotational center 200 of the hour wheel 232. The winding mark drive wheel 344 includes a first segment portion 344*a*, a second segment portion 344*c* and a third segment portion 344*f*. The first segment portion 344*a* is arranged at a region between substantially 12 o'clock direction and substantially 4 o'clock direction of the dial 110. The second segment portion 344*c* is arranged at a region between substantially 6 o'clock direction and substantially 7 o'clock direction of the dial 110. The third segment portion 344*f* is arranged at a region between substantially 9 o'clock direction and substantially 10 o'clock direction of the dial 110.

A first segment gear 344*b* is provided at the first segment portion 344*a*. A second segment gear 344*d* are provided at the second segment portion 344*c*. A third segment gear 344*g* is provided at the segment portion 344*f*. It is preferable to constitute such that an outer diameter (pitch diameter) of the first segment gear 344*b*, an outer diameter (pitch diameter) of the second segment gear 344*d* and an outer diameter (pitch diameter) of the third segment gear 344*g* are constituted by the same dimension. It is preferable that an opening angle of the first segment gear 344*a* is about 130 degrees. It is preferable that an opening angle of the second segment gear 344*d* is about 40 degrees. It is preferable that an opening angle of the third segment gear 344*g* is about 40 degrees. A portion of the first segment gear 344*b* is constituted to be brought in mesh with the second winding mark intermediate gear 182*a*. Other portion of the first segment gear 344*b* is constituted to be brought in mesh with the winding mark gear 190*a*.

The winding mark drive wheel 344 constitutes "deformed segment gear" having the three segment gears having the outer diameters (pitch diameters) of the same dimension. The winding mark drive wheel 344 is constituted by the "deformed segment gear" because it is necessary to avoid the first corrector setting transmission wheel 257, the first corrector setting transmission wheel 258, the date indicator driving wheel 250 and the date jumper 253. The first segment gear 344*b* is constituted to be brought in mesh with the second winding mark intermediate gear 182*a*. The first segment gear 340*b* is constituted to be brought in mesh with winding mark gear 190*a*. By the constitution, the rotational center of the winding mark hand 196 (that is, rotational center of the power reserve indicator) can be arranged at an arbitrary pertinent position in the movement of the timepiece regardless of the position of the rotational center of the barrel gear 120*d*. Further, by the constitution, an influence of backlashes of mesh among gears for transmitting rotation to the winding mark hand 196 can be reduced and operation of the winding mark hand 196 can effectively be prevented from being retarded. For example, the second main plate 112 is constituted to be able to integrate the winding mark drive wheel 344 at least at positions of 3 portions to be able to be applied to any of the fourth embodiment, the fifth embodiment and the sixth embodiment of the timepiece having the main plate winding state display apparatus of the invention. The second main plate 112, the date indicator maintaining plate 116, the winding mark drive wheel 344, and the winding mark indicator 190 are constituted to be able to integrate the same winding mark indicator 190 at a plurality of positions to be able to be applied to any of the fourth embodiment, the fifth embodiment and the sixth embodiment of the timepiece having the mainspring winding state display apparatus of the invention. It is preferable to constitute the second main plate 112 and the date indicator maintaining plate 116 to be able to integrate the winding mark indicator, 190 at other position to be able to be applied to also a constitution for providing the winding mark indicator 190 at other position. According to the invention, by using the single movement, the main plate winding state can be displayed by constituting the rotational center by a plurality of positions and therefore, timepieces having a plurality of designs can easily be realized.

(5) Fifth Embodiment

Figure 13:
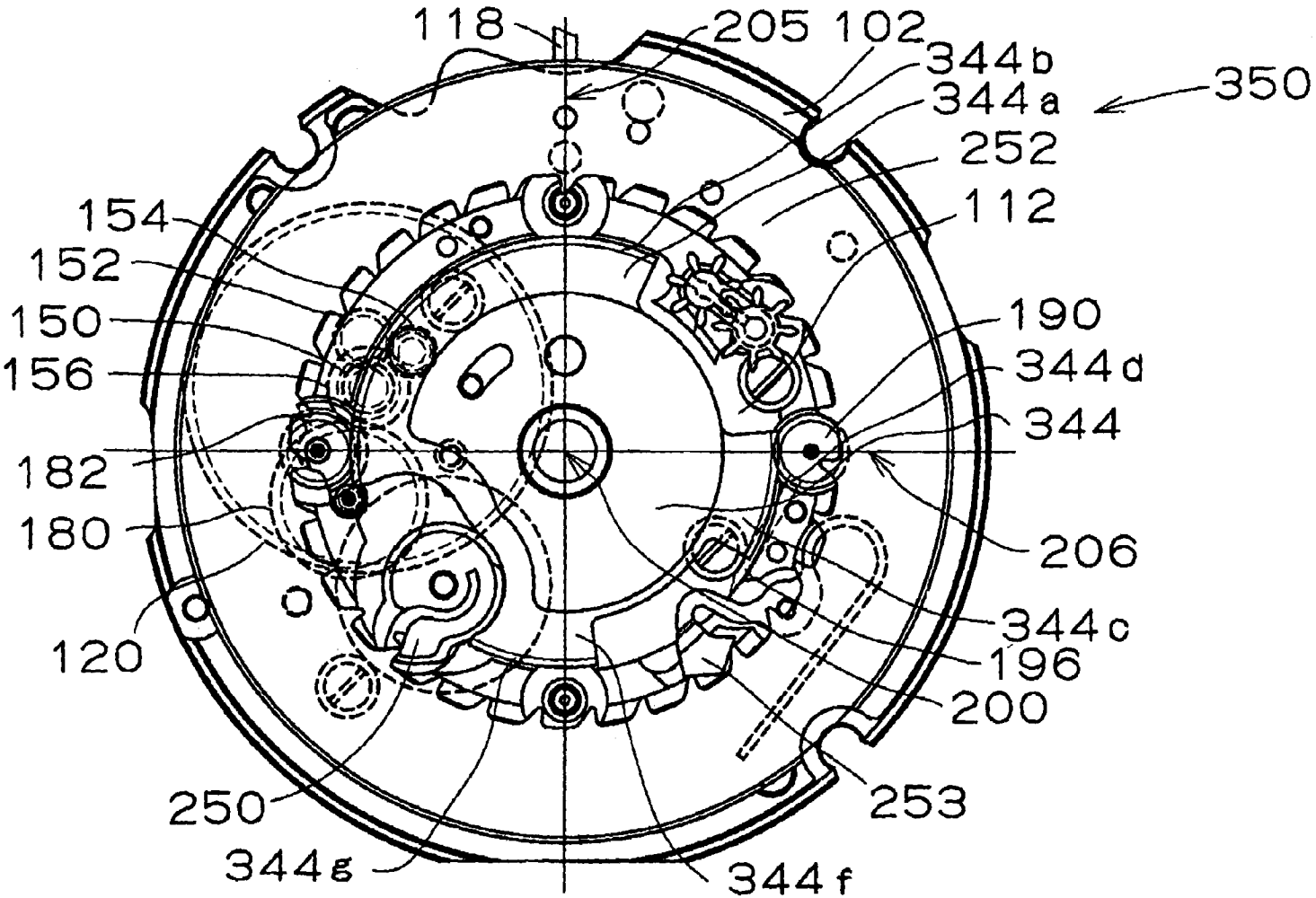
FIG. 13 is a plane view (back plane view) showing a state of viewing a movement in a state in which a mainspring is released from a side of a dial according to a fifth embodiment of a timepiece having a mainspring winding state display apparatus of the invention.
Figure 14:
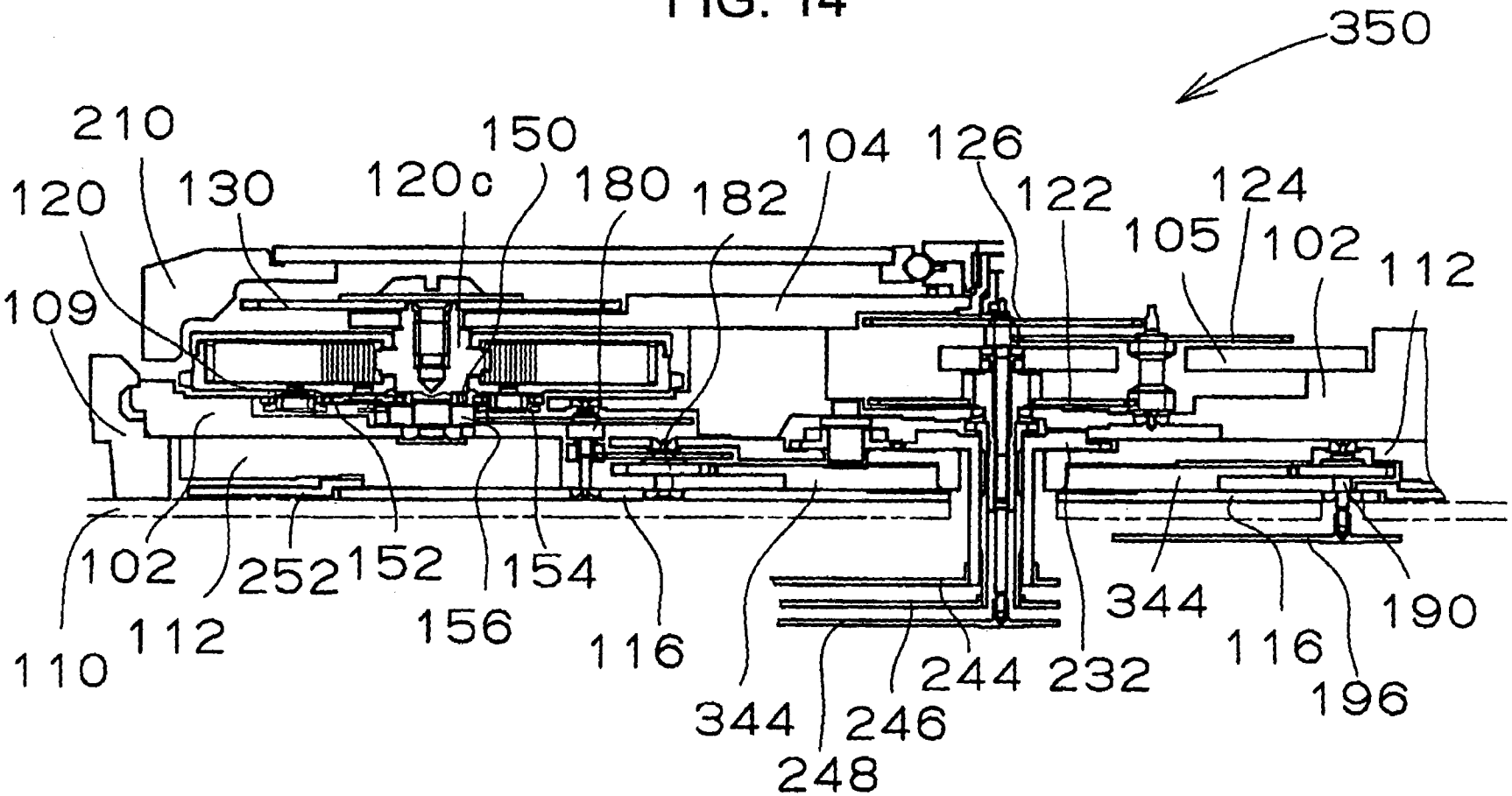
FIG. 14 is a partial sectional view showing a portion of the movement according to the fifth embodiment of the timepiece having the mainspring winding state display apparatus of the invention.

Next, a fifth embodiment of a timepiece having a mainspring winding state display apparatus of the invention will be explained. In the following explanation, a description will mainly be given of points of the fifth embodiment of the timepiece having the mainspring winding state display apparatus of the invention different from the fourth embodiment of the timepiece having the mainspring winding state display apparatus of the invention. Therefore, the above-descried explanation of the first embodiment of the timepiece having the mainspring winding state display apparatus and the fourth embodiment of the timepiece having the mainspring winding state display apparatus will be applied to a portion which is not described in the following. In reference to FIG. 13 and FIG. 14, according to the fifth embodiment of the timepiece having the mainspring winding state display apparatus of the invention, in a movement 350 of the timepiece having the mainspring winding state display apparatus, the rotational center of the winding mark indicator 190 is arranged at a region on the main plate reference horizontal axis line 206 and in 6 o'clock direction of the dial 110. The winding mark drive wheel 344 is rotatably supported by the second main plate 112. It is preferable that the rotational center of the winding mark drive wheel 344 is arranged at the same position as that of the rotational center 200 of the hour wheel 232. The first segment gear 344*b* is constituted to be brought in mesh with the second winding mark intermediate gear 182*a*. The second segment gear 344*d* is constituted to be brought in mesh with the winding mark gear 190*a*. By the constitution, the rotational center of the winding hand 196 (that is, rotational center of the power reserve indicator) can be arranged at an arbitrary pertinent position in the movement of the timepiece regardless of the position of the rotational center of the barrel gear 120*d*. Further, by the constitution, an influence of backlashes of mesh among gears for transmitting rotation to the winding mark hand 196 can be reduced and operation of the winding mark hand 196 can effectively be prevented from being retarded.

(6) Sixth Embodiment

Figure 15:
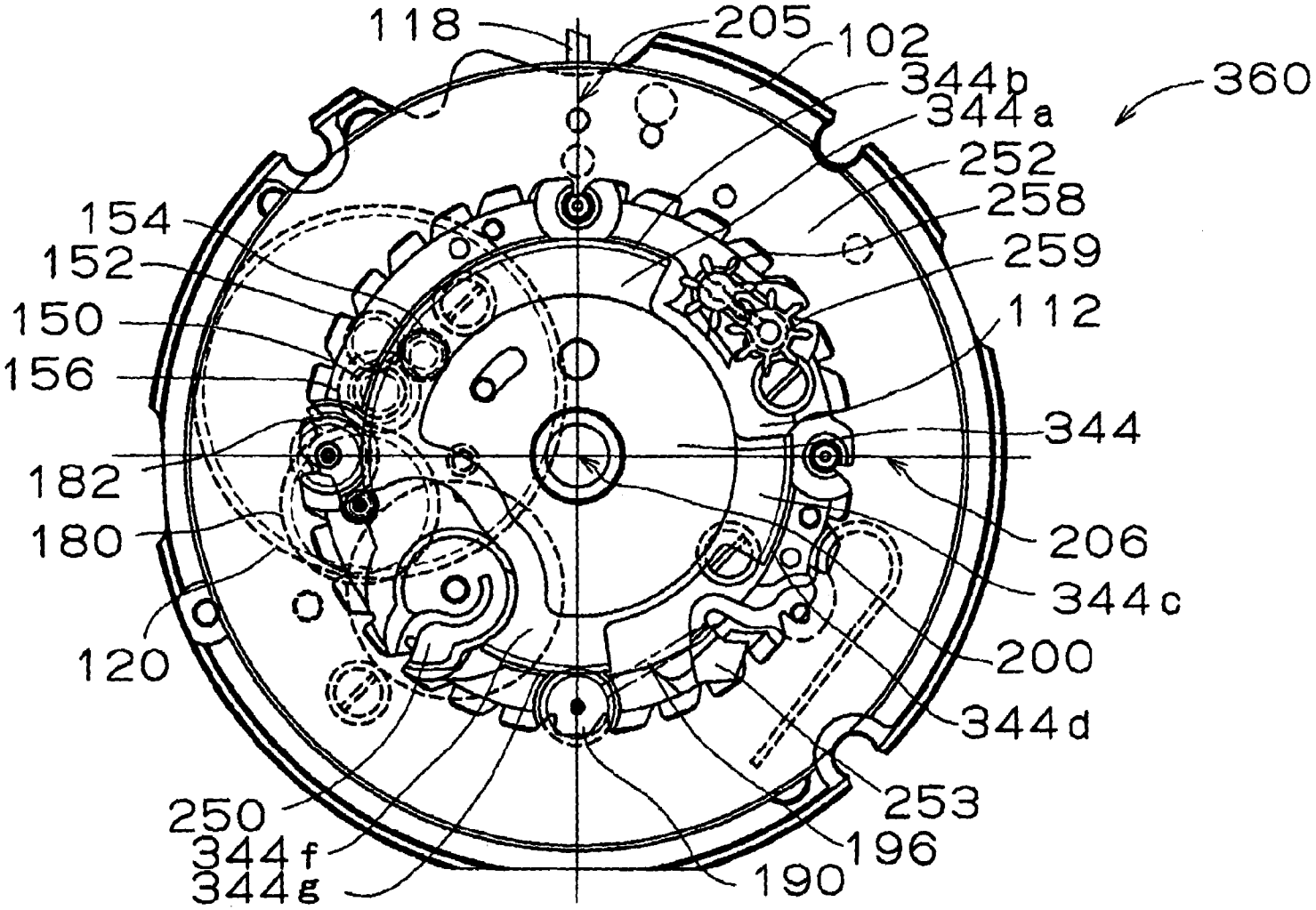
FIG. 15 is a plane view (back plane view) showing a state of viewing a movement in a state in which a mainspring is released from a side of a dial according to a sixth embodiment of a timepiece having a mainspring winding state display apparatus of the invention.
Figure 16:
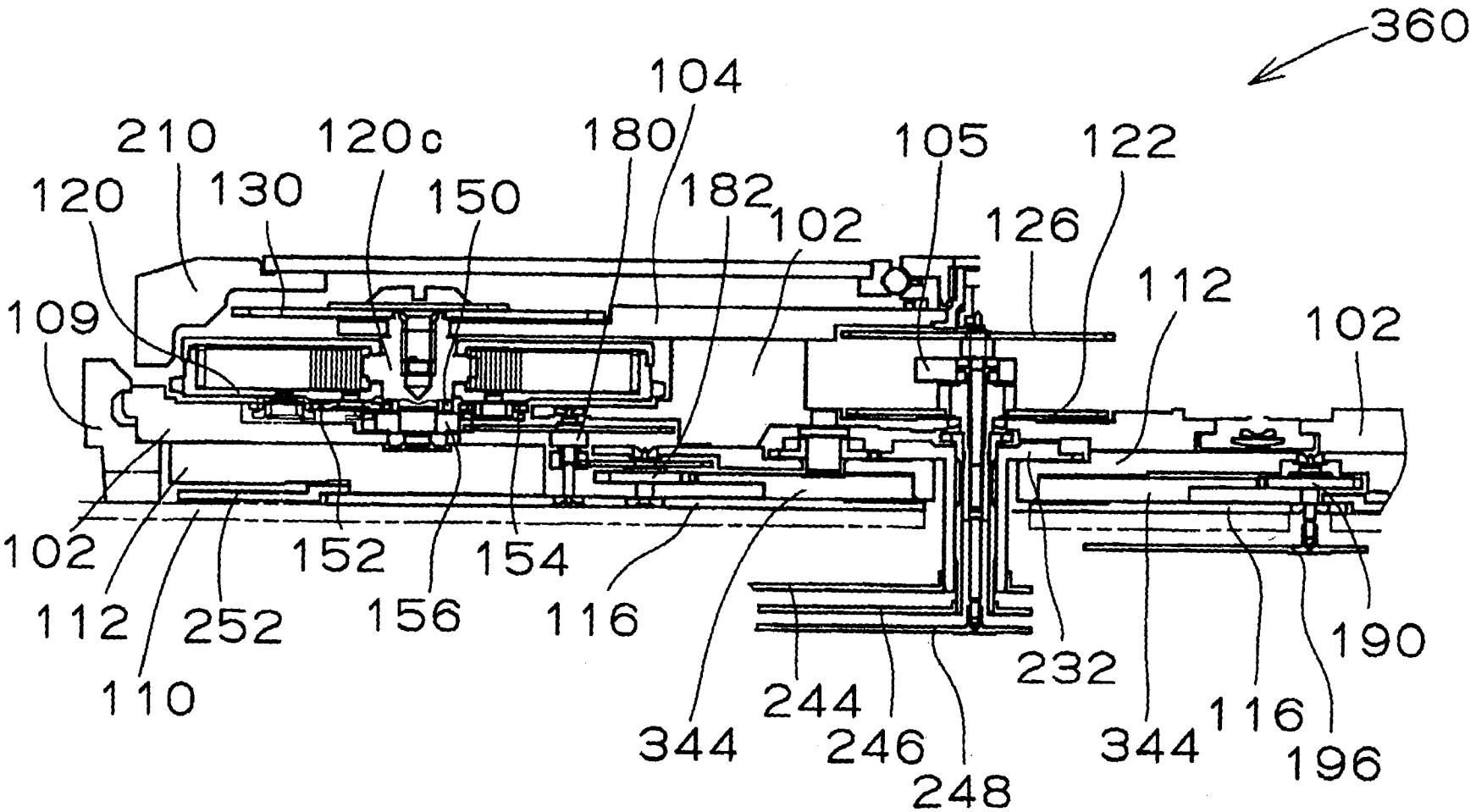
FIG. 16 is a partial sectional view showing a portion of the movement according to the sixth embodiment of the timepiece having the mainspring winding state display apparatus of the invention.

Next, a sixth embodiment of a timepiece having a mainspring winding state display apparatus of the invention will be explained. In the following explanation, a description will mainly be given of points of the sixth embodiment of the timepiece having the mainspring winding state display apparatus of the invention different from the fourth embodiment of the timepiece having the mainspring winding state display apparatus of the invention. Therefore, the above-described explanation of the first embodiment of the timepiece having the mainspring winding state display apparatus of the invention and the above-described explanation of the fourth embodiment of the timepiece having the mainspring winding state display apparatus of the invention will be applied to a portion which is not described in the following. In reference to FIG. 15 and FIG. 16, according to the sixth embodiment of the timepiece having the mainspring winding state display apparatus of the invention, in a movement 360 of the timepiece having the mainspring winding state display apparatus, the rotational center of the winding mark indicator 190 is arranged at a region on the main plate reference vertical axis line 205 and in 9 o'clock direction of the dial 110. The winding mark drive wheel 344 is roatably supported by the second main plate 112. It is preferable to arrange the rotational center of the winding mark drive wheel 344 at the same position as the rotational center 200 of the hour wheel 232. The first segment gear 344*b* is constituted to be brought in mesh with the second winding mark intermediate gear 182*a*. The third segment gear 344*g* is constituted to be brought in mesh with the winding mark gear 190*a*. By the constitution, the rotational center of the winding mark hand 196 (that is, rotational center of the power reserve indicator) can be arranged at an arbitrary pertinent position in the movement of the timepiece regardless of the position of the rotational center of the barrel gear 120*d*. Further, by the constitution, an influence of backlashes of mesh among gears for transmitting rotation to the winding mark hand 196 can be reduced and operation of the winding mark hand 196 can effectively be prevented from being retarded.

(7) Seventh Embodiment

Figure 17:
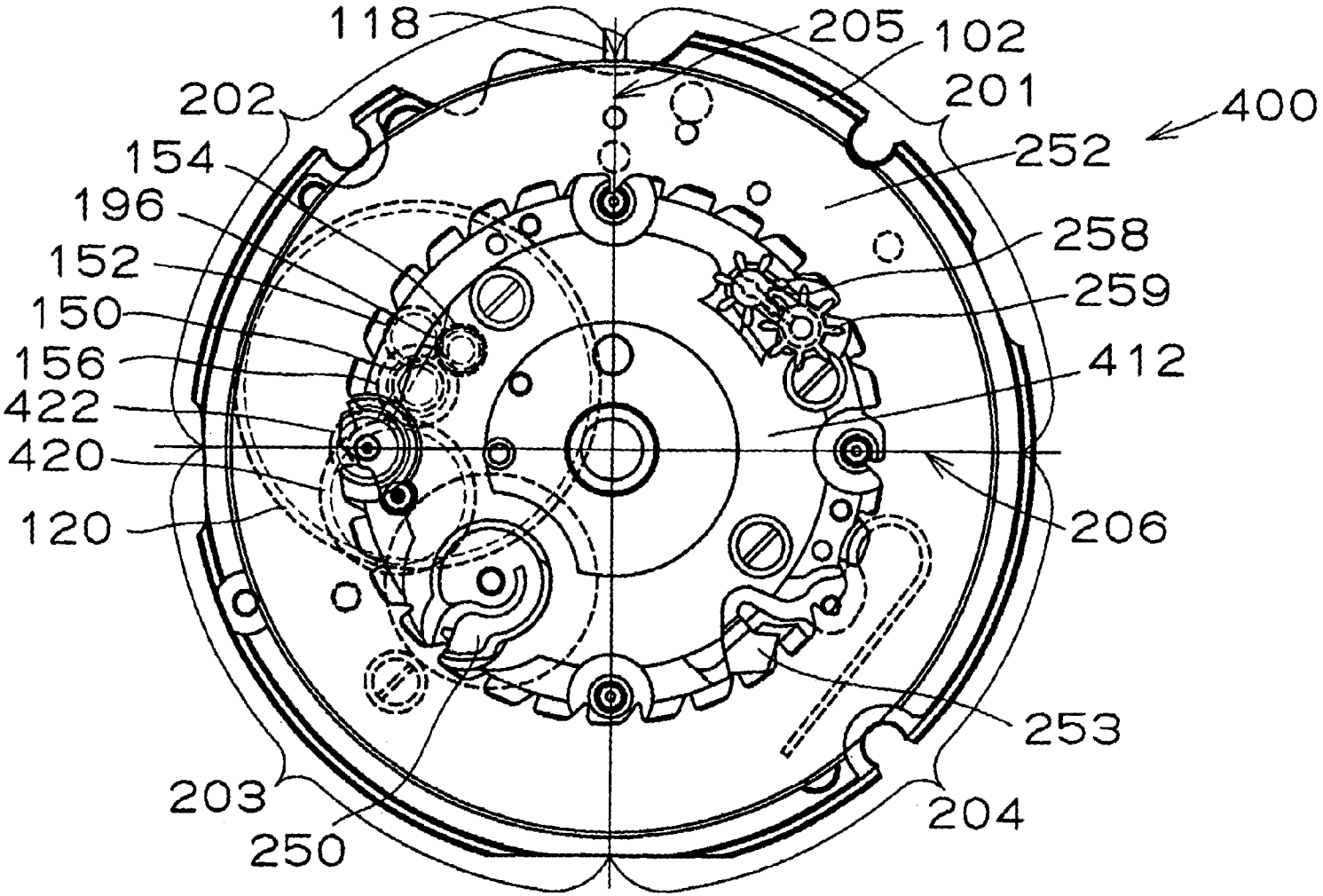
FIG. 17 is a plane view (back plane view) showing a state of viewing a movement in a state in which a mainspring is released from a side of a dial according to a seventh embodiment of the timepiece having a mainspring winding state display apparatus of the invention.
Figure 18:
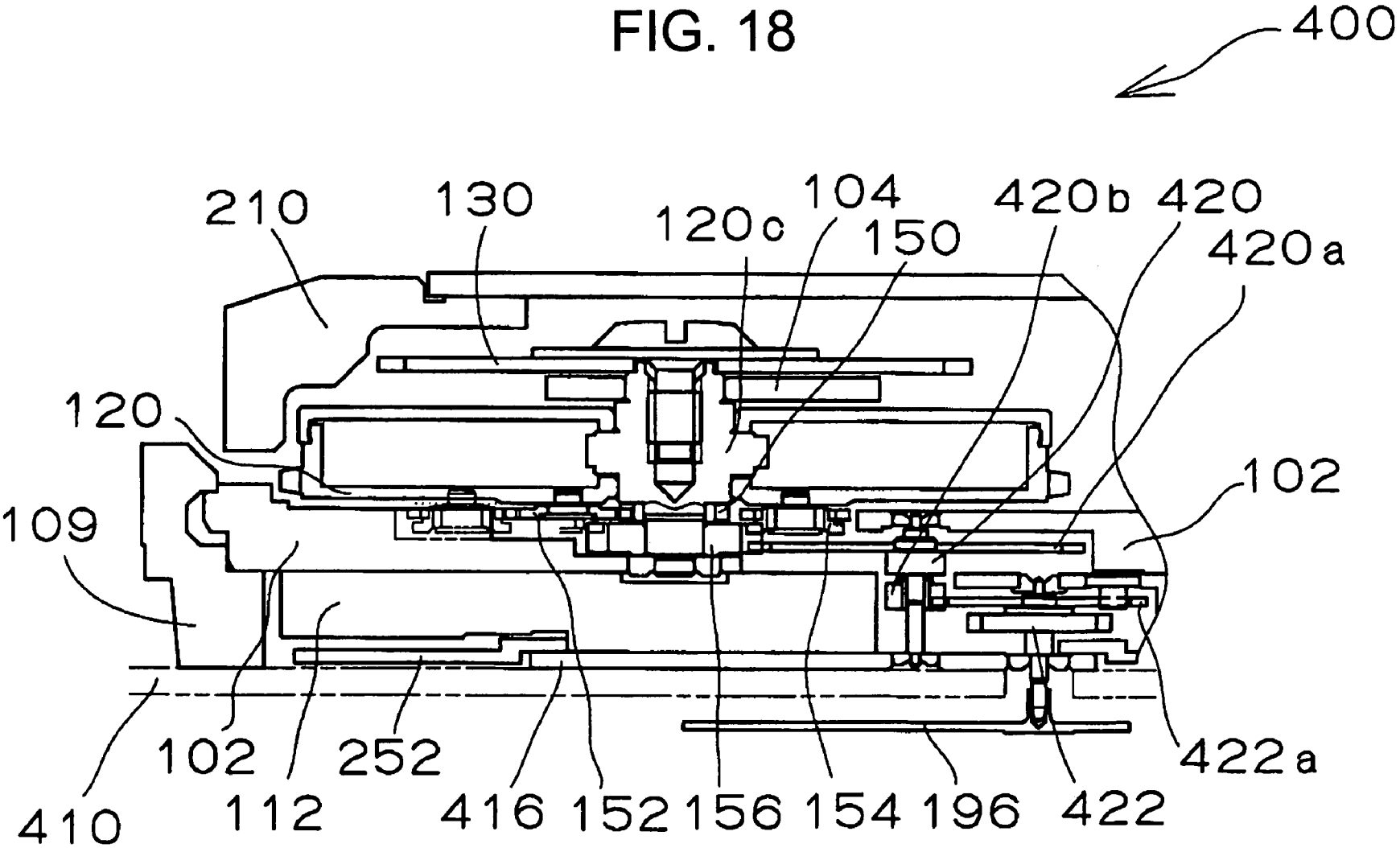
FIG. 18 is a partial sectional view showing a portion of the movement according to the seventh embodiment of the timepiece having the mainspring winding state display apparatus of the invention.
Figure 19:
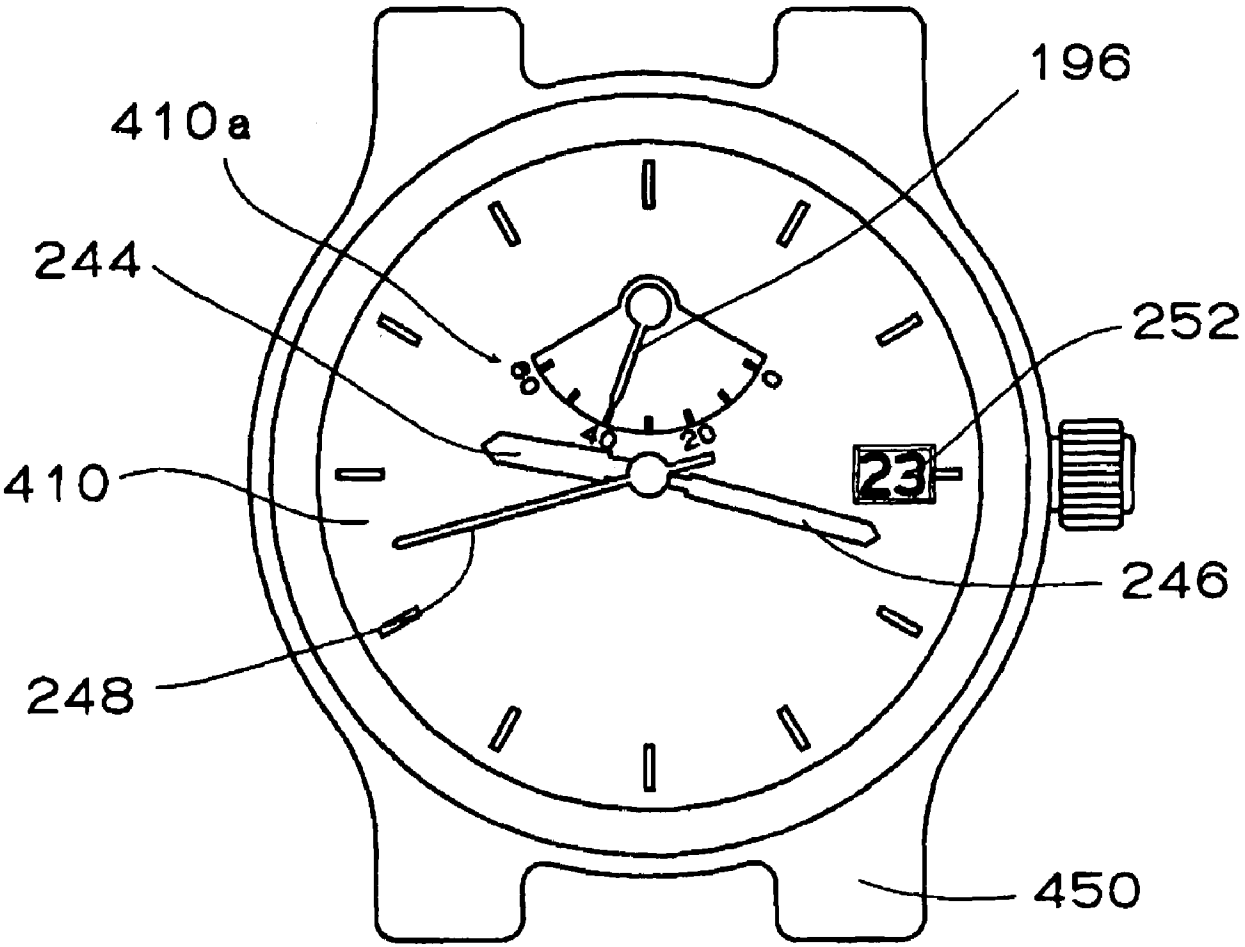
FIG. 19 is a plane view showing an outlook of a complete in a state in which the mainspring is wound back to a middle location according to the seventh embodiment of the timepiece having the mainspring winding state display apparatus of the invention.

Next, a seventh embodiment of a timepiece having a mainspring winding state display apparatus of the invention will be explained. In the following explanation, a description will mainly be given of points of the seventh embodiment of the timepiece having the mainspring winding state display apparatus of the invention different from the first embodiment of the timepiece having the mainspring winding state display apparatus of the invention. Therefore, the above-described explanation of the first embodiment of the timepiece having the mainspring winding state display apparatus of the invention will be applied to a portion which is not described in the following. In reference to FIG. 17 and FIG. 18, according to the seventh embodiment of the timepiece having the mainspring winding state display apparatus of the invention, a dial 410 is attached to the main plate 102 via a dial support ring 409. The winding mark intermediate wheel 420 is rotatably supported by the main plate 120 and a date indicator maintaining plate 416. A winding mark intermediate wheel 420 includes a winding mark intermediate gear 420*a* and a winding mark intermediate pinion 420*b*. The wining mark intermediate gear 420*a* is constituted to be brought in mesh with the second sun gear 150. It is preferable to arrange a rotational center of the winding mark intermediate wheel 420 at the third region 203. A winding mark indicator 422 is rotatably supported by a second main plate 412 and the date indicator maintaining plate 416. The winding mark indicator 422 includes a winding mark gear 422*a*. The winding mark gear 422*a* is constituted to be brought in mesh with the winding mark intermediate wheel 420. A rotational center of the winding mark indicator 422 is arranged at a region on the main plate reference horizontal axis line 206 and in 12 o'clock direction of the dial 410. The winding mark hand 196 constituting the main plate winding state display member is attached to a winding mark indicator stem of the winding mark indicator 422. According to the constitution, in reference to FIG. 19, a display sign 410*a* indicating the mainspring winding state is provided at the dial 410. For example, the display sign 110*a* includes numerals of "0", "20", "40", "60". A user can know the state of winding the mainspring by a position of a front end of the winding mark hand 196 and the display sign 410*a*.

In the state of completely winding back the mainspring 120*b*, when the ratchet wheel 130 is rotated in the clockwise direction by rotation of the automatic winding train wheel, the winding mark intermediate wheel 420 is rotated via operation of the planetary mechanism. The winding mark indicator 190 is rotated in the clockwise direction by rotation of the winding mark intermediate wheel 420. In the state of winding up the mainspring, the winding mark intermediate wheel 420 is rotated via operation of the planetary mechanism by rotation of the barrel gear 120*d*. The winding mark indicator 190 is rotated in the counterclockwise direction by rotation of the winding mark intermediate wheel 420. Therefore, as winding back (releasing) the mainspring 120*b* by rotating the barrel complete 120, the winding mark hand 196 is rotated in the counterclockwise direction at a speed lower than a normal rotational speed of the train wheel. As has been explained above, according to the timepiece having the mainspring winding state display apparatus of the invention, the duration of the timepiece can be displayed very comprehensively.

The first example of the timepiece having the mainspring winding state display apparatus of the invention can be constituted by the following condition as an example.

the number of teeth of the barrel gear 120*d:* 84 the number of teeth of the ratchet wheel 130: 62 the number of teeth of the first sun wheel 150: 20 the number of teeth of the first planetary wheel 152: 24 the number of teeth of the gear of the second planetary wheel 154: 20 the number of teeth of the pinion of the second planetary wheel 154: 12 the number of teeth of the gear of the first winding mark intermediate wheel 180: 48 the number of teeth of the pinion of the first winding mark intermediate wheel 180: 8 the number of teeth of the second sun wheel 156: 24 the number of teeth of the first segment gear 184*c* (a calculated value when teeth are present over an entire periphery): 200 the number of teeth of the second segment gear 184*g* (a calculated value when teeth are present over an entire periphery): 104 the number of teeth of the winding mark indicator 190: 13

According to the constitution, a speed reducing ratio from the barrel gear 120*d* to the winding mark indicator 190 is 1/18. Further, when the number of winding of the mainspring is 6 turns, the indicator 196 attached to the winding mark indicator 190 can be moved by 120 degrees. Further, when the number of winding of the mainspring is 7 turns, the indicator 196 attached to the winding mark indicator 190 can be moved by 140 degrees.

Further, according to the timepiece having the mainspring winding state display apparatus of the invention, by changing the above-described numbers of teeth of the gears, a content of display of the mainspring winding state can be changed. Further, by changing the above-described speed reducing ratio, the angle of the rotation of rotating the winding mark hand 196 based on rotation of the barrel gear 120*d* can be changed. For example, according to a constitution of making the speed reducing ratio from the barrel gear 120*d* to the winding mark indicator 190/, when the same mainspring as that used in the above-described embodiments of the invention is used, the angle of the rotation of the winding mark indicator 190 in correspondence with from the state of releasing the spring to the fully winding state can be set to about 90 degrees.

The invention is applicable to the constitution of arranging the mainspring winding state display member (power reserve indicator) at an arbitrary pertinent position in the movement of the timepiece in the timepiece having the mainspring winding state display apparatus having the function of displaying the state of winding of the mainspring constituting the power source of the mechanical timepiece. That is, according to the invention, in the timepiece having the mainspring winding state display apparatus, the rotational center of the winding mark hand can be arranged at an arbitrary pertinent position in the movement of the timepiece regardless of the position of the rotational center of the barrel gear, a plurality of winding mark indicator supporting portions are provided in the movement and therefore, it is not necessary to prepare a plurality of movements for changing the position of the rotational center of the winding mark hand. Therefore, according to the timepiece having the mainspring winding state display apparatus of the invention, a restriction in view of design is very inconsiderable.

According to the timepiece having the mainspring winding state display apparatus of the invention, the rotational center of the mainspring winding state display member (that is, the rotational center of the winding mark hand) can be arranged at an arbitrary pertinent position in the movement of the timepiece regardless of the position of the rotational center of the barrel gear. Further, according to the timepiece having the mainspring winding state display apparatus of the invention, an influence of backlashes of mesh among gears for transmitting rotation to the winding mark hand can be reduced and operation of the winding mark hand can be prevented from being retarded. Further, the timepiece having the mainspring winding state display apparatus of the invention is small and thin, in addition thereto, a restriction in view of design is very incondsiderable.

What is claimed is:

1. A timepiece having a mainspring winding state display apparatus for displaying a winding state of a mainspring as a power source of the timepiece, the timepiece comprising:

a barrel complete having a mainspring as a power source of the timepiece, a barrel stem, and a barrel gear for undergoing rotational movement to wind back the mainspring, the barrel complete undergoing rotation in only one direction of rotation by winding back of the mainspring by the barrel gear;

a speed reducing mechanism for undergoing movement with the barrel gear for reducing a speed of rotation of the barrel gear;

a segment gear for undergoing rotation in accordance with an output of the speed reducing mechanism;

a winding mark display wheel for undergoing rotation in accordance with an operation of the segment gear; and a mainspring winding state display member for displaying a winding state of the mainspring in accordance with rotation of the winding mark display wheel;

wherein the segment gear comprises a first segment gear for receiving an output of the speed reducing mechanism, and a second segment gear for rotating the winding mark display wheel.

2. A timepiece having a mainspring winding state display apparatus according to claim 1; wherein the speed reducing mechanism comprises a planetary unit, the planetary unit having a first sun wheel fixed to the barrel stem, a planetary wheel rotatably fixed to a bottom face of the barrel gear, and a second sun wheel rotatably attached to the barrel stem, the planetary wheel undergoing rotation while revolving around the first sun wheel when the barrel gear is rotated.

3. A timepiece having a mainspring winding state display apparatus for displaying a winding state of a mainspring as a power source of the timepiece, the timepiece comprising:

a barrel complete having a mainspring as a power source of the timepiece, a barrel stem, and a barrel gear for undergoing rotational movement to wind back the mainspring, the barrel complete undergoing rotation in only one direction of rotation by winding back of the mainspring by the barrel gear;

a speed reducing mechanism for undergoing movement with the barrel gear for reducing a speed of rotation of the barrel gear;

a segment gear for undergoing rotation in accordance with an output of the speed reducing mechanism;

a winding mark display wheel for undergoing rotation in accordance with an operation of the segment gear; and a mainspring winding state display member for displaying a winding state of the mainspring in accordance with rotation of the winding mark display wheel;

wherein the timepiece has a main plate, a hand setting stem and an hour wheel; wherein a main plate reference vertical axis line passing a rotational center of the hour wheel and substantially in parallel with a center axis line of the hand setting stem and a main plate reference horizontal axis line passing the rotational center of the hour wheel and orthogonal to the main plate reference vertical axis line are defined at the main plate; wherein a first region disposed on a first side of the main plate reference vertical axis line and disposed on a side of the main plate reference horizontal reference vertical axis line proximate to the hand setting stem, a second region disposed on a second side of the main plate reference vertical axis line and disposed on a side of the horizontal axis line proximate to the hand setting stem, a third region disposed on the second side of the main plate reference vertical axis line where the second region is present and disposed on a side of the main plate reference horizontal axis line remote from the hand setting stem, and a fourth region disposed on the first side of the main plate reference vertical axis line where the first region is present and disposed on the side of the main plate reference horizontal axis line remote from the hand setting stem are defined at the main plate; and wherein a rotational center of the barrel complete is arranged at the second region, a rotational center of the speed reducing mechanism is arranged at the same position as the rotational center of the barrel complete, and a rotational center of the winding mark display wheel is arranged at a region on the main plate reference vertical axis line and in a 3 o'clock direction of a dial.

4. A timepiece having a mainspring winding state display apparatus according to claim 3; wherein the speed reducing mechanism comprises a planetary unit, the planetary unit having a first sun wheel fixed to the barrel stem, a planetary wheel rotatably fixed to a bottom face of the barrel gear, and a second sun wheel rotatably attached to the barrel stem, the planetary wheel undergoing rotation while revolving around the first sun wheel when the barrel gear is rotated.

5. A timepiece comprising:

a barrel complete having a mainspring as a power source for the timepiece and a barrel gear mounted for undergoing rotation to wind back the mainspring;

a speed reducing mechanism for undergoing movement with the barrel gear of the barrel complete to reduce a rotational speed of the barrel gear;

a segment gear for undergoing rotation in accordance with an output of the barrel gear;

a winding mark indicator for undergoing rotation in accordance with an operation of the segment gear; and a display member for displaying a winding state of the mainspring in accordance with rotation of the winding mark indicator;

wherein the segment gear comprises a first segment gear for receiving an output of the speed reducing mechanism and a second segment gear for rotating the winding mark indicator.

6. A timepiece according to claim 5; wherein the speed reducing mechanism comprises a planetary unit.

7. A timepiece according to claim 6; wherein the barrel complete has a barrel stem; and wherein the planetary unit comprises a first sun wheel integrally connected to the barrel stem, a planetary wheel rotatably mounted to a lower surface of the barrel gear, and a second sun wheel rotatably mounted on the barrel stem, the planetary wheel undergoing rotation while revolving around the first sun wheel when the barrel year undergoes rotation.

* * * * *